US007381032B2

(12) United States Patent
Osaka et al.

(10) Patent No.: US 7,381,032 B2
(45) Date of Patent: Jun. 3, 2008

(54) HERMETIC COMPRESSOR AND FREEZING AIR-CONDITIONING SYSTEM

(75) Inventors: Masahiko Osaka, Chigasaki (JP); Hidetoshi Nishihara, Fujisawa (JP); Toshihiko Ota, Fujisawa (JP); Akihiko Kubota, Chigasaki (JP); Manabu Motegi, Koshigaya (JP); Hiroki Awashima, Fujisawa (JP); Takeshi Kojima, Yokohama (JP); Kazuhito Noguchi, Chigasaki (JP); Ichiro Kita, Fujisawa (JP); Masahiro Kakutani, Fujisawa (JP)

(73) Assignee: Matsushita Refrigeration Company, Osaka (JP)

( * ) Notice: Subject to any disclaimer, the term of this patent is extended or adjusted under 35 U.S.C. 154(b) by 525 days.

(21) Appl. No.: 10/432,028

(22) PCT Filed: Nov. 26, 2001

(86) PCT No.: PCT/JP01/10279

§ 371 (c)(1),
(2), (4) Date: Sep. 25, 2003

(87) PCT Pub. No.: WO02/42644

PCT Pub. Date: May 30, 2002

(65) Prior Publication Data

US 2005/0100456 A1 May 12, 2005

(30) Foreign Application Priority Data

Nov. 27, 2000 (JP) ..... 2000-359012

(51) Int. Cl.
*F04B 39/00* (2006.01)
*F01N 1/02* (2006.01)
*F02M 35/00* (2006.01)

(52) U.S. Cl. ..... 417/312; 181/249; 181/250; 181/229

(58) Field of Classification Search ..... 181/250, 181/273, 276, 249, 269, 229, 403; 417/312
See application file for complete search history.

(56) References Cited

U.S. PATENT DOCUMENTS 5,220,811 A * 6/1993 Harper et al. ..... 62/296
5,304,044 A * 4/1994 Wada et al. ..... 417/312
5,496,156 A * 3/1996 Harper et al. ..... 417/312
5,584,674 A * 12/1996 Mo ..... 417/312
5,733,108 A * 3/1998 Riffe ..... 417/542
5,888,055 A * 3/1999 Lee ..... 417/312
5,971,720 A * 10/1999 Fagotti et al. ..... 417/312
5,988,990 A * 11/1999 Lee ..... 417/312
5,992,170 A * 11/1999 Yap ..... 62/296
6,129,522 A * 10/2000 Seo ..... 417/312
6,149,402 A * 11/2000 Kim ..... 417/312

* cited by examiner

*Primary Examiner*—Devon Kramer
*Assistant Examiner*—Jessica L Frantz
(74) *Attorney, Agent, or Firm*—Louis Woo

(57) ABSTRACT

In a hermetic compressor in a freezing refrigerating system or an air-conditioning system such as a refrigerator or a showcase, a construction is disclosed for intending to provide a low-noise hermetic compressor by effectively attenuating a pressure pulsation having occurred in a compression chamber with a suction muffler. By this construction, since a muffler cover 20 has a planar simple shape, the deformation upon molding becomes little and it can come into fully close contact with a muffler main body 19. Therefore, the pressure pulsation hardly leaks through the connecting portion between the muffler main body 19 and the muffler cover 20. The full silencing effect that the suction muffler 18 has is obtained and thereby noise can be reduced more effectively.

20 Claims, 16 Drawing Sheets

HERMETIC COMPRESSOR AND FREEZING AIR-CONDITIONING SYSTEM

TECHNICAL FIELD

The present invention relates to a hermetic compressor in a freezing air-conditioning system such as a refrigerator or a showcase.

BACKGROUND ART

In recent years, for a hermetic compressor in a freezing refrigerating system or air-conditioning system such as a refrigerator or a showcase, there are required an improvement in efficiency, a reduction of noise and highly reliable techniques, and besides, it is also an important factor to inexpensively provide the compressor.

A conventional hermetic compressor is shown in U.S. Pat. No. 5,971,720.

The above conventional hermetic compressor will be described below with reference to drawings. FIG. 14 is a sectional view of the conventional hermetic compressor. FIG. 15 is an exploded perspective view of a suction muffler attached to a cylinder head of the conventional hermetic compressor.

In FIG. 14, reference numeral 1 denotes a hermetic vessel. Reference numeral 2 denotes a compressing element, which is accommodated in the hermetic vessel 1. Reference numeral 3 denotes an electric motor element, which is connected with the compressing element 2. Reference numeral 4 denotes a cylinder, which defines a compression chamber 5 of the compressing element 2. Reference numeral 6 denotes a piston, which reciprocates in the cylinder 4. Reference numeral 7 denotes a valve plate, which seals one end of the cylinder 4. Reference numeral 8 denotes a cylinder head, which fixes the valve plate 7 to the cylinder 4 and fixes a suction muffler (not illustrated in FIG. 13) to the valve plate 7. Reference numeral 10 denotes a suction pipe. Reference numeral 11 denotes freezer oil, which is collected in the bottom portion of the hermetic vessel 1.

In FIG. 15, reference numeral 12 denotes a suction muffler as silencing means for attenuating noise generated in the compression chamber 5 and a suction valve (not illustrated). In view of an improvement in performance of the hermetic compressor, it is desirably made of a material with a low thermal conductivity, e.g. a synthetic resin material. In consideration of the use environment of a coolant gas atmosphere and a high temperature, the synthetic resin material may be a material of PBT or PPS.

The suction muffler 12 is made up from a muffler main body 13 and a muffler cover 9. The muffler main body 13 and the muffler cover 9 are joined to each other by welding or fitting to define a muffler space 14. Reference numeral 15 denotes an inlet pipe, whose one end is open in the hermetic vessel 1 and other end is open to the muffler space 14. Reference numeral 16 denotes an outlet pipe, whose one end is open to the valve plate 7 side and other end is open to the muffler space 14.

The operation of the hermetic compressor constructed as above will be described below. Coolant gas that has returned from a freezing cycle (not illustrated) to the hermetic compressor is once released into the hermetic vessel 1 through the suction pipe 10. The coolant gas then passes through the suction muffler 12 and the valve plate 7 and flows in the compression chamber 5, where the coolant gas is compressed by the piston 6 that is reciprocating due to the rotation of the electric motor element 3, and then the coolant gas is sent to the freezing cycle.

At this time, a pressure pulsation of the coolant gas occurs in the compression chamber 5 due to the reciprocation of the piston 6 and the opening/closing operation of the suction valve. The pressure pulsation having occurred in the compression chamber 5 propagates in the reverse direction to the flow of the coolant gas, and is once released into the muffler space 14 through the outlet pipe 16. The pressure pulsation then attenuates by being released into the hermetic vessel 1 through the inlet pipe 15, and is radiated as low noise.

On the other hand, another conventional hermetic compressor is shown in U.S. Pat. No. 5,496,156. FIG. 16 is a sectional view of the other conventional hermetic compressor. In FIG. 16, reference numeral 18 denotes a hermetic vessel. Reference numeral 19 denotes a compressing element, which is accommodated in the hermetic vessel 18. Reference numeral 20 denotes an electric motor element, which is connected with the compressing element 19. Reference numeral 21 denotes a cylinder, which defines a compression chamber 22 of the compressing element 19. Reference numeral 23 denotes a piston, which reciprocates in the cylinder 21. Reference numeral 24 denotes a valve plate, which seals one end of the cylinder 21. Reference numeral 25 denotes a suction valve, which is interposed between the valve plate 24 and the cylinder 21. Reference numeral 26 denotes a cylinder head, which fixes the valve plate 24 to the cylinder 21 and fixes a suction muffler 27 to the valve plate 24. Reference numeral 28 denotes a suction pipe. Reference numeral 29 denotes freezer oil, which is collected in the bottom portion of the hermetic vessel 18. The suction muffler 27 is made up from a suction muffler main body 30 and a suction muffler cover 31. The suction muffler main body 30 and the suction muffler cover 31 are joined to each other by welding or fitting to define a muffler space 32. Reference numeral 33 denotes an inlet portion, which fluidly connects the hermetic vessel 18 and the muffler space 32 with each other. Reference numeral 34 denotes an outlet pipe, whose one end is open to the valve plate 24 side and other end is open to the muffler space 32.

The operation of the hermetic compressor constructed as above will be described below. Coolant gas that has returned from a freezing cycle (not illustrated) to the hermetic compressor is once released into the hermetic vessel 18. The coolant gas then passes through the suction muffler 27 and the valve plate 24 and flows in the compression chamber 22, where the coolant gas is compressed by the piston 23 that is reciprocating due to the rotation of the electric motor element 20, and then the coolant gas is sent to the freezing cycle.

At this time, a pressure pulsation having occurred in the compression chamber 22 propagates in the reverse direction to the flow of the coolant gas, and is once released into the muffler space 32 through the outlet pipe 34. The pressure pulsation then attenuates by being released into the hermetic vessel 18 through the inlet portion 33, and is radiated as low noise.

The above-described conventional construction, however, has a complicated shape because the muffler main body 13 and the muffler cover 9 form the respective side wall surfaces of the suction muffler 12. The complicated shape causes an increase in cost for manufacture. Besides, since the complicated shape further causes a large deformation upon molding, the insufficient connection between the muffler main body 13 and the muffler cover 9 brings about a leakage. Therefore, a sufficient silencing effect can not be obtained. The above conventional construction has these disadvantages.

DISCLOSURE OF THE INVENTION

The present invention is to provide an inexpensive low-noise hermetic compressor in which a muffler cover is made into a simple shape only with a single wall surface, thereby decreasing a cost for manufacture, and further, since deformation can be reduced thereby, a sufficiently close contact can be obtained in the connection between a muffler main body and the muffler cover.

Furthermore, in the above-described conventional constructions, it is an effective measure for obtaining a high efficiency to dispose close to each other the opening portion on the muffler space 14 side of the inlet pipe 15 and the opening portion on the muffler space 14 side of the outlet pipe 16, or the opening portion on the muffler space 32 side of the inlet portion 33 and the opening portion on the muffler space 32 side of the outlet pipe 34 to decrease the fluid resistance. However, the above-described conventional constructions have a disadvantage that a sufficient silencing effect can not be obtained because the fluid resistance is reduced also in relation to pressure pulsations having occurred in the compression chamber 5 and the compression chamber 22.

Another object of the present invention is to provide low-noise hermetic compressors in which fluid resistance means is added between the opening on the muffler space side of the inlet pipe and the opening portion on the muffler space side of the outlet pipe, thereby attenuating a pressure pulsation having occurred in the compression chamber.

Besides, the above-described conventional constructions have a disadvantage that pressure pulsations having occurred in the compression chamber 5 and the compression chamber 22 are released as sound sources through the opening portion on the hermetic vessel 1 or 18 side of the inlet pipe 15 or the inlet portion 33, besides they vibrate the wall surfaces of the suction muffler 12 and the suction muffler 27 to make new noise sources.

Another object of the present invention is to provide low-noise hermetic compressors in which the wall surface of the suction muffler is formed integrally with the inlet pipe and the outlet pipe and since the rigidity of the wall surface of the suction muffler can be improved thereby, the vibration of the wall surface can be suppressed.

Besides, in the above-described conventional constructions, it is an effective measure for obtaining a high efficiency that the opening portion on the hermetic vessel 1 side of the inlet pipe 15 has a volume. But, the provision of such a volume for the opening portion on the hermetic vessel 1 side of the inlet pipe 15 with the wall surface quite different from the wall surface where the suction muffler 12 is formed causes a complicated shape of the suction muffler 12 and it brings about an increase in cost for manufacture. On the other hand, there is a limit in space for providing a sufficient volume in the opening portion on the hermetic vessel 18 side of the inlet portion 33 that is on the wall surface where the suction muffler 27 is formed. If the volume of the opening portion on the hermetic vessel 18 side of the inlet portion 33 is increased in order to obtain a high efficiency, the muffler space 32 is reduced. This causes a disadvantage that a sufficient silencing effect can not be obtained.

Another object of the present invention is to provide low-noise highly-efficient inexpensive hermetic compressors in which the volume of the opening portion on the hermetic vessel side is defined by a wall surface different from the wall surface of the suction muffler and thereby an increased volume of the opening portion on the hermetic vessel side can be obtained without reducing the volume of the suction muffler, and a simple shape of the suction muffler can be obtained.

Another object of the present invention is to provide highly reliable hermetic compressors in which the velocity of the coolant gas flow in the outlet pipe is high and thereby a sufficient supply amount of the freezer oil from a capillary can be ensured.

Another object of the present invention is to provide hermetic compressors safe also for the environment by applying the hermetic compressors with the incorporated suction muffler as described above to a coolant not containing chlorine.

Another object of the present invention is to provide hermetic compressors safe also for the environment by applying the hermetic compressors with the incorporated suction muffler as described above to a hydrocarbon-base coolant.

Another object of the present invention is to provide a highly reliable freezing refrigerating system and air-conditioning system safe also for the environment in which noise caused by hermetic compressors is reduced by applying the hermetic compressors as described above to the freezing refrigerating system and air-conditioning system such as a refrigerator and a showcase.

The present invention comprises a hermetic vessel, an electric motor element, a compressing element to be driven and rotated by said electric motor element, a suction pipe disposed in said hermetic vessel, and a suction muffler made up from a muffler main body and a muffler cover. Said muffler main cover comprises an inlet pipe whose one end is open in the hermetic vessel and other end is open in said suction muffler, an outlet pipe whose one end is open in said suction muffler and other end is open to said compressing element, and a wall surface except an upper side wall surface of wall surfaces defining a muffler space. Said muffler cover forms only the upper side wall surface of the wall surfaces defining said muffler space. The present invention has an effect that by making said muffler cover into a simple shape only with a single wall surface, the cost for manufacture is reduced, and further, since the deformation can be reduced, a sufficiently close contact can be obtained in the connection between said muffler main body and said muffler cover, and the silencing effect of said suction muffler can be increased furthermore.

In the present invention, a wall surface for defining a resonance space is formed integrally with the muffler cover. The present invention has an effect that since the resonance space can easily be added without any change in the muffler main body, the cost for manufacture is reduced and noise of the frequency corresponding to the resonance space is reduced.

In the present invention, at least one wall surface of wall surfaces defining the resonance space is along an inner wall surface of the suction muffler. The present invention has an effect that the volume of the resonance space can be increased and the pressure pulsation component reduction effect of the frequency corresponding to the resonance space can be increased.

The present invention comprises a hermetic vessel, an electric motor element, a compressing element to be driven and rotated by said electric motor element, a suction pipe disposed in said hermetic vessel, and a suction muffler. Said suction muffler comprises an inlet pipe whose one end is open in the hermetic vessel and other end is open in said suction muffler, an outlet pipe whose one end is open in said suction muffler and other end is open to the compressing element, and a shielding wall between an opening portion on said suction muffler side of said inlet pipe and an opening portion on said suction muffler side of said outlet pipe. The present invention has an effect that since the propagation path can be elongated through the reflection on said shielding wall without directly propagating a pressure pulsation having occurred in a compression chamber from said outlet pipe to said inlet pipe, a large attenuation can be obtained.

In the present invention, the shielding wall is formed integrally with one of wall surfaces of the suction muffler. The present invention has an effect that it can easily be manufactured without providing separate connecting means for said shielding wall and the suction muffler, and since the propagation path of a pressure pulsation having occurred in a compression chamber can be elongated, a large attenuation can be obtained.

In the present invention, the shielding wall is formed integrally with the muffler cover. The present invention has an effect that since said shielding wall can easily be added without any change of the muffler main body, the cost for manufacture can be reduced, and since the propagation path of a pressure pulsation having occurred in a compression chamber can be elongated, a large attenuation can be obtained.

In the present invention, a lower end portion of the shielding wall is located on a straight line extending between the center of an opening portion on the suction muffler side of the inlet pipe and the center of an opening portion on the suction muffler side of the outlet pipe, or nearer to a position on the upper end portion side of said shielding wall. The present invention has an effect that while the path of coolant gas flowing from said inlet pipe to said outlet pipe is near to a straight line extending between the center of the opening portion on said suction muffler side of said inlet pipe and the center of the opening portion on said suction muffler side of said outlet pipe, the path of the coolant gas flowing from said outlet pipe to said inlet pipe with a pressure pulsation having occurred in the compression chamber is radial with the opening portion on said suction muffler side of said outlet pipe as the center, and by serving as a fluid resistance only against the pressure pulsation having occurred in said compression chamber, a large attenuation to the pressure pulsation having occurred in said compression chamber can be obtained without hindering the efficiency.

The present invention comprises a hermetic vessel, an electric motor element, a compressing element to be driven and rotated by said electric motor element, a suction pipe disposed in said hermetic vessel, and a suction muffler made up from a muffler main body and a muffler cover. Said muffler main cover comprises an inlet pipe whose one end is open in said hermetic vessel and other end is open in said suction muffler, an outlet pipe whose one end is open in said suction muffler and other end is open to said compressing element, and a wall surface except an upper side wall surface of wall surfaces defining a muffler space. Said inlet pipe and said outlet pipe are formed integrally with said wall surface, respectively. The present invention has an effect that by improving the rigidity of the wall surface of said suction muffler, the wall surface vibration can be suppressed.

In the present invention, an opening portion on the suction muffler side of the outlet pipe is located substantially at the center of a space in the suction muffler. The present invention has an effect that a low-order resonance vibration that the muffler space has solely can be suppressed.

In the present invention, the outlet pipe is formed integrally with a wall surface on the hermetic vessel side of the suction muffler. The present invention has an effect that by improving the rigidity of the wall surface on the hermetic vessel side of said suction muffler, the wall surface vibration on the hermetic vessel side that is apt to appear as noise can be suppressed.

The present invention comprises a hermetic vessel, an electric motor element, a compressing element to be driven and rotated by said electric motor element, a suction pipe disposed in said hermetic vessel, and a suction muffler. Said suction muffler is made up from an introducing portion whose one end is open in said hermetic vessel and other end is open in an inlet pipe, said inlet pipe whose one end is open to said introducing portion and other end is open in said suction muffler, an outlet pipe whose one end is open in said suction muffler and other end is open to said compressing element, and a wall surface for defining a muffler space. Said introducing portion is formed by a wall surface different from a wall surface of said suction muffler and an opening portion on said suction muffler side of said introducing portion faces said suction pipe by said introducing portion wall surface. The present invention has an effect that since the volume of said introducing portion can be increased without reducing said muffler space, coolant gas flowing in through said suction pipe can be introduced into said suction muffler at a low temperature, besides the shape of said suction muffler can be simplified.

In the present invention, the introducing portion has a substantially rectangular opening portion on the hermetic vessel side and a substantially rectangular-parallelepiped inner space. The present invention has an effect that since the volume of said introducing portion can be increased more without reducing the muffler space, a larger amount of coolant gas flowing in through said suction pipe can be introduced into said suction muffler at a low temperature, besides the shape of said suction muffler can be simplified.

The present invention comprises a hermetic vessel, an electric motor element, a compressing element to be driven and rotated by said electric motor element, freezer oil staying in a lower portion of said hermetic vessel, a suction pipe disposed in said hermetic vessel, a suction muffler, and a capillary whose one end is open in said freezer oil and other end is open in an outlet pipe of said suction muffler. Said suction muffler has an inlet pipe whose one end is open in said hermetic vessel and other end is open in said suction muffler, and the outlet pipe composed of a continuous body of pipe having at least two inner diameters whose one end is open in said suction muffler and other end is open to said compressing element. The present invention has an effect that since the flow velocity of coolant gas in said outlet pipe can be increased, a sufficient supply quantity of freezer oil from said capillary can be ensured.

In the present invention, an inner diameter of a pipe on the compressing element side of the outlet pipe is smaller than an inner diameter of a pipe on the suction muffler side of said outlet pipe. The present invention has an effect that since the flow velocity of coolant gas in the pipe on the compressing element side of said outlet pipe can be higher than the flow velocity of the coolant gas in the pipe on said suction muffler side of said outlet pipe so as not to hinder the flow of the coolant gas from the opening portion on said suction muffler side toward the opening portion on the compressing element side of said outlet pipe, a sufficient supply quantity of freezer oil from said capillary can be ensured.

In the present invention, a connecting position between a pipe on the compressing element side of the outlet pipe and a pipe on the suction muffler side of said outlet pipe is substantially equal to said outlet pipe opening position of the capillary, or at a position nearer to an opening portion on said suction muffler side of said outlet pipe. The present invention has an effect that since the flow velocity of coolant gas near said outlet pipe opening position of said capillary can be increased, a sufficient supply quantity of freezer oil from said capillary can be ensured.

The present invention is a hermetic compressor used for a coolant not containing chlorine. All effects as described above can be obtained even under the coolant environment not containing chlorine.

The present invention is a hermetic compressor used for a hydrocarbon-base coolant. All effects as described above can be obtained even under the hydrocarbon-base coolant environment.

The present invention is a freezing refrigerating system or an air-conditioning system such as a refrigerator or a showcase in which the hermetic compressor is incorporated. All effects as described above can be obtained even under operation conditions as any of said freezing refrigerating system and air-conditioning system.

BEST MODE FOR CARRYING OUT THE INVENTION

Hereinafter, preferred embodiments of hermetic compressor of the present invention will be described with reference to drawings.

Embodiment 1

Figure 1:
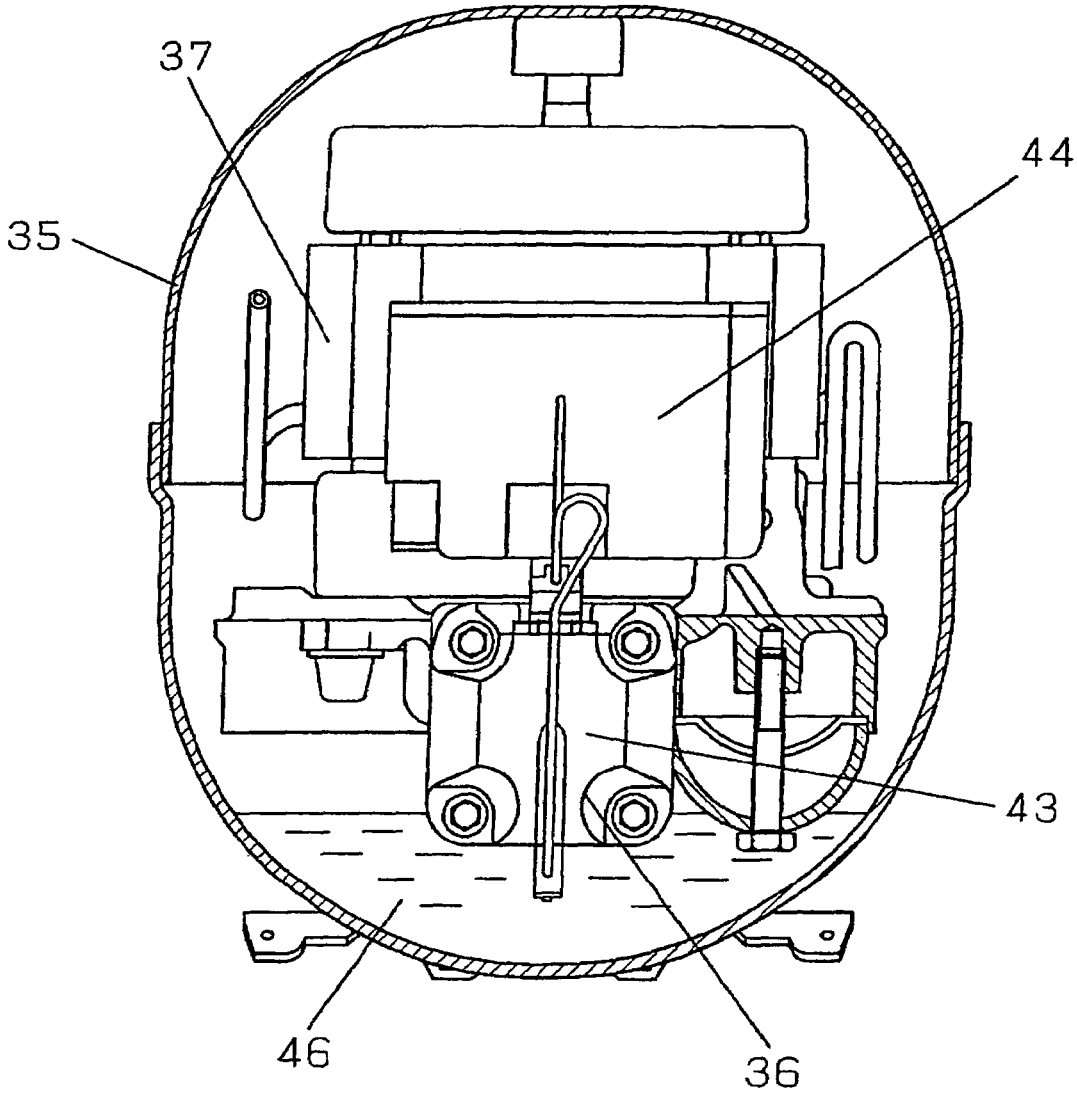
FIG. 1 is a front view of a principal part of a hermetic compressor according to embodiment 1.
Figure 2:
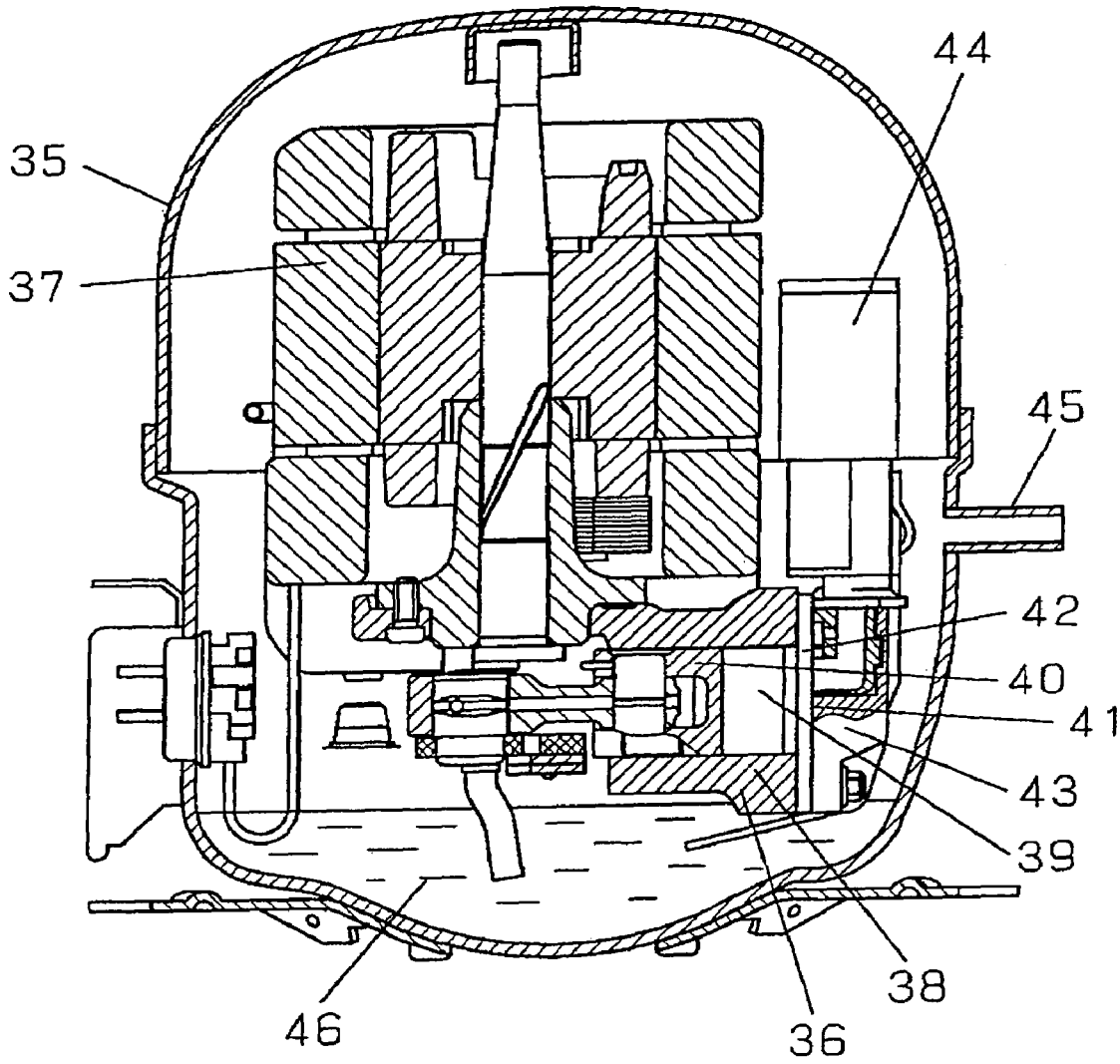
FIG. 2 is a sectional view of the principal part of the hermetic compressor according to embodiment 1.
Figure 3:
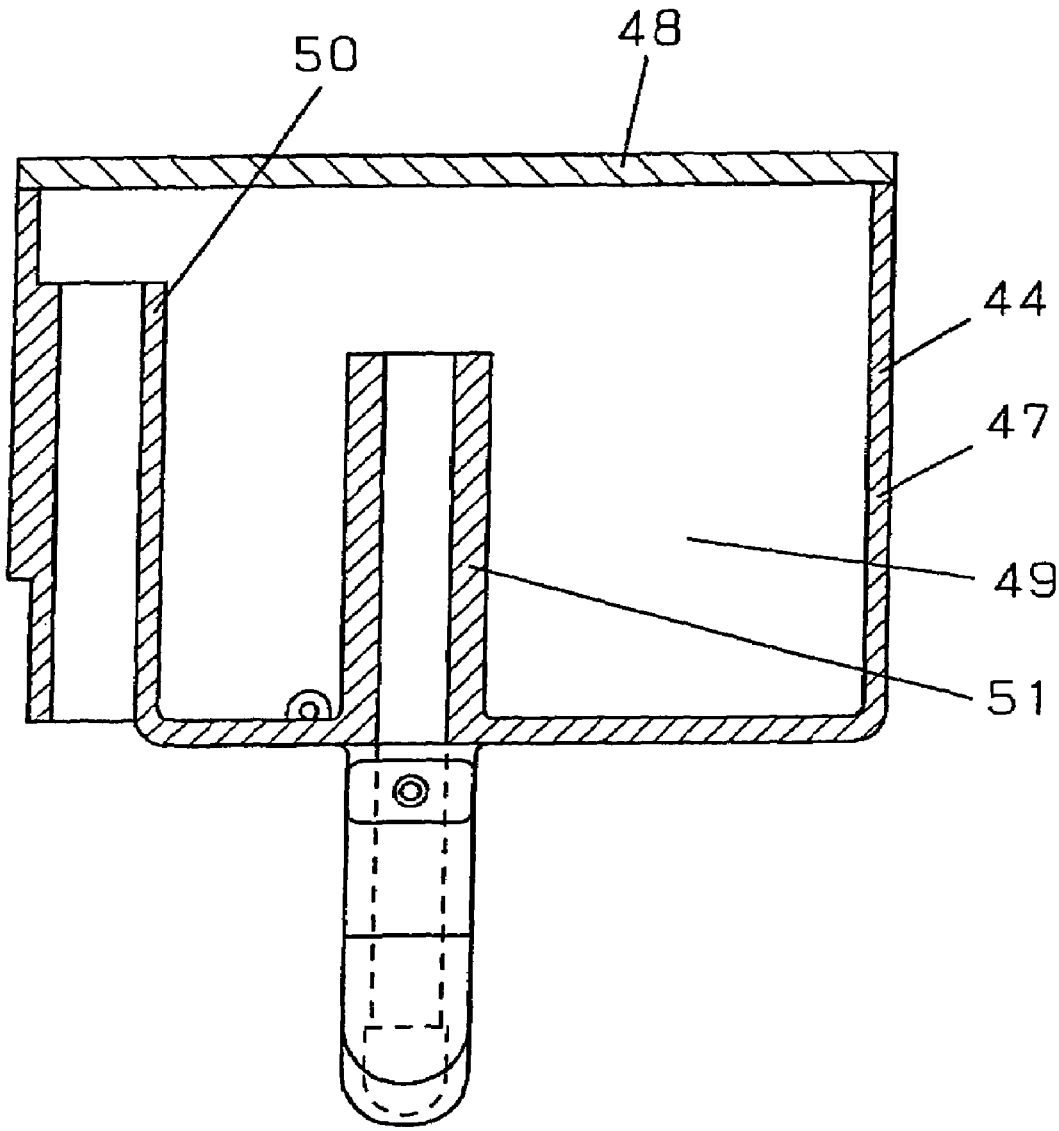
FIG. 3 is a sectional view of a principal part of a suction muffler used in the hermetic compressor according to embodiment 1.

FIG. 1 is a front view of a principal part of a hermetic compressor according to embodiment 1 of the present invention. FIG. 2 is a sectional view of the principal part of the hermetic compressor according to embodiment 1 of the present invention. FIG. 3 is a sectional view of a principal part of a suction muffler used in the hermetic compressor according to embodiment 1 of the present invention.

In FIGS. 1, 2, and 3, reference numeral 35 denotes a hermetic vessel. Reference numeral 36 denotes a compressing element, which is accommodated in the hermetic vessel 35. Reference numeral 37 denotes an electric motor element, which is connected with the compressing element 36. Reference numeral 38 denotes a cylinder, which defines a compression chamber 39 of the compressing element 36. Reference numeral 40 denotes a piston, which reciprocates in the cylinder 38. Reference numeral 41 denotes a valve plate, which seals one end of the cylinder 38. Reference numeral 42 denotes a suction valve, which is interposed between the valve plate 41 and the cylinder 38. Reference numeral 43 denotes a cylinder head, which fixes the valve plate 41 to the cylinder 38 and fixes a suction muffler 44 to the valve plate 41. Reference numeral 45 denotes a suction pipe. Reference numeral 46 denotes freezer oil, which is collected in the bottom portion of the hermetic vessel 35.

The suction muffler 44 is a silencer as means for attenuating noise generated in the compression chamber 39 or the suction valve 42. In view of an improvement in performance of the hermetic compressor, it is desirably made of a material with a low thermal conductivity, e.g. a synthetic resin material. In consideration of the use environment of a coolant gas atmosphere and a high temperature, the synthetic resin material may be a material of PBT or PPS.

Reference numeral 47 denotes a muffler main body and reference numeral 48 denotes a muffler cover, which are in general welded and joined with each other through a supersonic welding process to form the suction muffler 44. The muffler cover 48 has a planar simple shape and has a function as an upper-side wall surface for defining a muffler space 49. Reference numeral 50 denotes an inlet pipe, whose one end is open in the hermetic vessel 35 and other end is open in the suction muffler 44. The inlet pipe 50 is formed integrally with the muffler main body 47. Reference numeral 51 denotes an outlet pipe, whose one end is open in the suction muffler 44 and other end is open on the compressing element 36 side. The outlet pipe 51 is formed integrally with the muffler main body 47.

The operation of the hermetic compressor constructed as above will be described below. Coolant gas that has returned from a freezing cycle (not illustrated) to the hermetic compressor is once released into the hermetic vessel 35 through the suction pipe 45. The coolant gas then passes through the suction muffler 44 and the valve plate 41 and flows in the compression chamber 39, where the coolant gas is compressed by the piston 40 that is reciprocating due to the rotation of the electric motor element 37, and then the coolant gas is sent to the freezing cycle.

At this time, a pressure pulsation of the coolant gas occurs in the compression chamber 39 due to the reciprocation of the piston 40 and the opening/closing operation of the suction valve 42. The pressure pulsation having occurred in the compression chamber 39 propagates in the reverse direction to the flow of the coolant gas, and is once released into the muffler space 49 through the outlet pipe 51. Here, since the muffler cover 48 has a planar simple shape, it is even in thickness and so it suffers only a little deformation due to shrinkage or strain upon molding. In the connection with the muffler main body 47, therefore, the weldability is good in comparison with the case of a large deformation upon molding. Since this brings about a good seal, the pressure pulsation hardly leaks through the connection portion between the muffler main body 47 and the muffler cover 48. The silencing effect that the suction muffler 44 has is fully obtained. Thus, since the pressure pulsation released into the muffler space 49 through the outlet pipe 51 can fully be attenuated and then it can be released into the hermetic vessel 35 through the inlet pipe 50, noise can be reduced more effectively.

Besides, by making the muffler cover 48 into a planar simple shape, the cost for molds can be reduced and the weight of the material can be decreased. Therefore, the cost for manufacturing the muffler cover 48 can be reduced. Further, since the shape of a receiving jig necessary for supersonic welding takes the same shape as the simple shape of the muffler cover 48, the cost for the jig mold can also be reduced.

Embodiment 2

Figure 4:
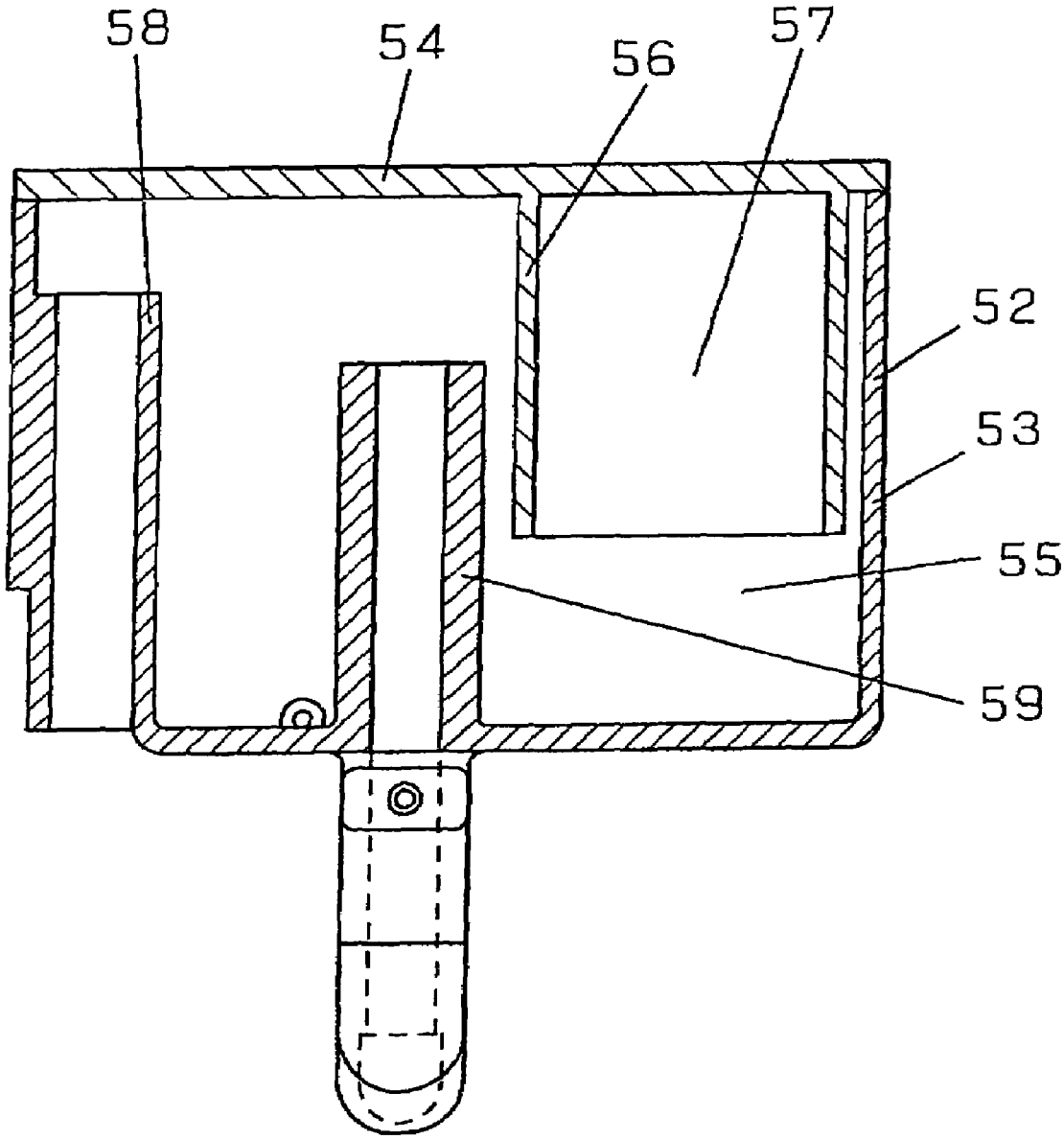
FIG. 4 is a sectional view of a principal part of a suction muffler used in a hermetic compressor according to embodiment 2.
Figure 5:
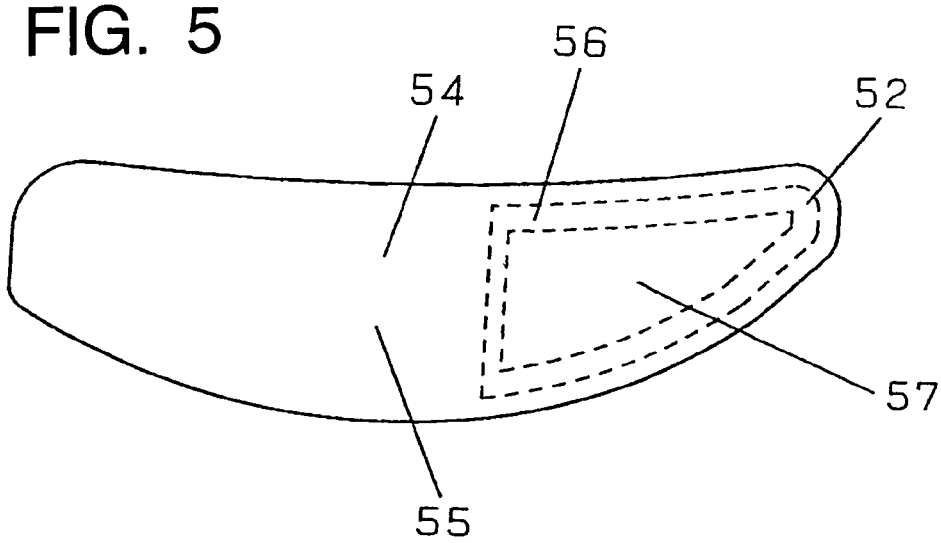
FIG. 5 is a top view of a muffler cover used in the hermetic compressor according to embodiment 2.

FIG. 4 is a sectional view of a principal part of a suction muffler used in a hermetic compressor according to embodiment 2 of the present invention and FIG. 5 is a top view of its muffler cover. Note that the hermetic compressor using the suction muffler illustrated in FIG. 4 differs from the hermetic compressor illustrated in FIG. 1 only in the suction muffler, so it is not illustrated.

In FIGS. 4 and 5, reference numeral 52 denotes a suction muffler, which is made up from a muffler main body 53 and a muffler cover 54. The muffler main body 53 and the muffler cover 54 are joined with each other through a process of welding or the like to form a muffler space 55.

Reference numeral 56 denotes a cylindrical resonance space wall, which is formed integrally with the muffler cover 54 so as to extend along the inner wall surface of the muffler main body 53 and which defines a resonance space 57. Reference numeral 58 denotes an inlet pipe, whose one end is open in the hermetic vessel 35 and other end is open in the suction muffler 52. The inlet pipe 58 is formed integrally with the muffler main body 53. Reference numeral 59 denotes an outlet pipe, whose one end is open in the suction muffler 52 and other end is open on the compressing element 36 side. The outlet pipe 59 is formed integrally with the muffler main body 53.

The operation of the hermetic compressor constructed as above will be described below. A pressure pulsation having occurred in the compression chamber 39 propagates in the reverse direction to the flow of coolant gas, and then it is once released into the muffler space 55 through the outlet pipe 59, the pressure pulsation component of the frequency corresponding to the resonance space 57 is concentrically reduced, and then the pressure pulsation is released into the hermetic vessel 35 through the inlet pipe 58, thereby reducing noise more effectively. More specifically, the space in the hermetic vessel 35 has a resonance frequency of about 500 Hz under the environment of R134a coolant and a resonance frequency of about 500 to 630 Hz under the environment of R600a coolant. If silencing at these frequencies is insufficient, the hermetic compressor generates very high noise. So, since these frequency components contained in the pressure pulsation can be absorbed into the resonance space 57 by making the resonance frequency of the resonance space 57 coincide with these frequencies, vibration to the space in the hermetic vessel 35 can be reduced and the noise of the hermetic compressor can be lowered. Further, since the amount of absorption of the pressure pulsation is determined in accordance with the volume of the resonance space 57, forming the resonance space wall 56 so as to extend along the inner surface of the muffler main body 53 is an effective noise reduction measure.

Embodiment 3

Figure 6:
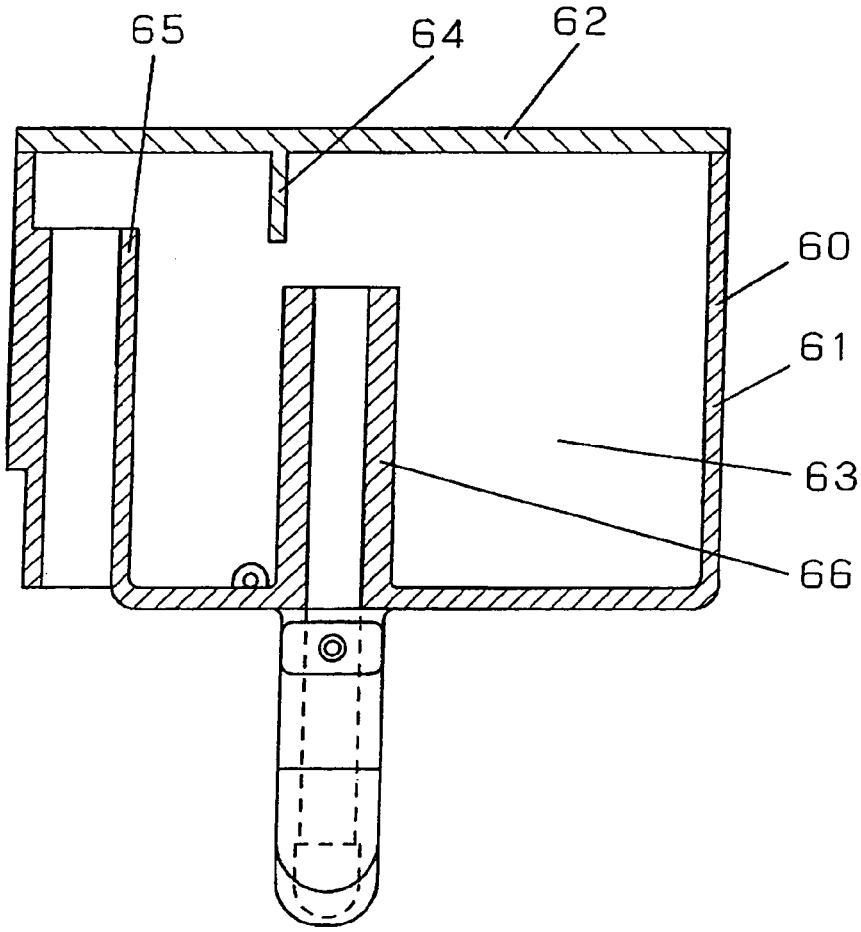
FIG. 6 is a sectional view of a principal part of a suction muffler used in a hermetic compressor according to embodiment 3.

FIG. 6 is a sectional view of a principal part of a suction muffler used in a hermetic compressor according to embodiment 3 of the present invention. Note that the hermetic compressor using the suction muffler illustrated in FIG. 6 differs from the hermetic compressor illustrated in FIG. 1 only in the suction muffler, so it is not illustrated.

In FIG. 6, reference numeral 60 denotes a suction muffler, which is made up from a muffler main body 61 and a muffler cover 62. The muffler main body 61 and the muffler cover 62 are joined with each other through a process of welding or the like to form a muffler space 63. Reference numeral 64 denotes a shielding wall, which is formed integrally with the muffler cover 62 on the upper end portion side of the shielding wall 64. The lower end portion of the shielding wall 64 is on the upper end portion side of the shielding wall 64 than a straight line connecting between the center of the opening portion on the suction muffler 60 side of an inlet pipe 65 and the center of the opening portion on the suction muffler 60 side of an outlet pipe 66.

The inlet pipe 65 has its one end open in the hermetic vessel 35 and its other end open in the suction muffler 60. The inlet pipe 65 is formed integrally with the muffler main body 61. The outlet pipe 66 has its one end open in the suction muffler 60 and its other end open on the compressing element 36 side. The outlet pipe 66 is formed integrally with the muffler main body 61.

The operation of the hermetic compressor constructed as above will be described below. Since coolant gas flows substantially linearly from the opening portion on the suction muffler 60 side of the inlet pipe 65 toward the opening portion on the suction muffler 60 side of the outlet pipe 66 due to a suction force generated by the reciprocation of the piston 40, it can smoothly flow into the compression chamber 39 irrespective of the shielding wall 64 and thereby the efficiency can be maintained. On the other hand, a pressure pulsation having occurred in the compression chamber 39 propagates in the reverse direction of the flow of the coolant gas and it is radially released into the muffler space 63 through the outlet pipe 66. At this time, as for the pressure pulsation, since a long propagation path for the pressure pulsation can be obtained by reflecting the pressure pulsation propagating toward the inlet pipe 65 as an outlet from the muffler space 63 by the shielding wall 64 without being directly radiated, a great attenuation can be obtained, thereby reducing noise more effectively. More specifically, the pressure pulsation having occurred in the compression chamber 39 contains wide components from a low frequency component such as an operation frequency to a high frequency component of 5 kHz or more, in particular, the pulsation level of a high frequency component of 2 k to 4 kHz is high. As a method for reducing the pulsation level, a method is well-known in which, for example, the inner diameter of the inlet pipe 65 or the outlet pipe 66 is decreased. But, it has a negative effect that the efficiency as one of important characteristics of the hermetic compressor is reduced. So, since the high frequency component has a nature that it well attenuates in accordance with the length of the propagation path, the shielding wall 64 that can elongates the propagation path only for the pressure pulsation having occurred in the compression chamber 39 is effective means for reducing noise with maintaining the efficiency.

Figure 17:
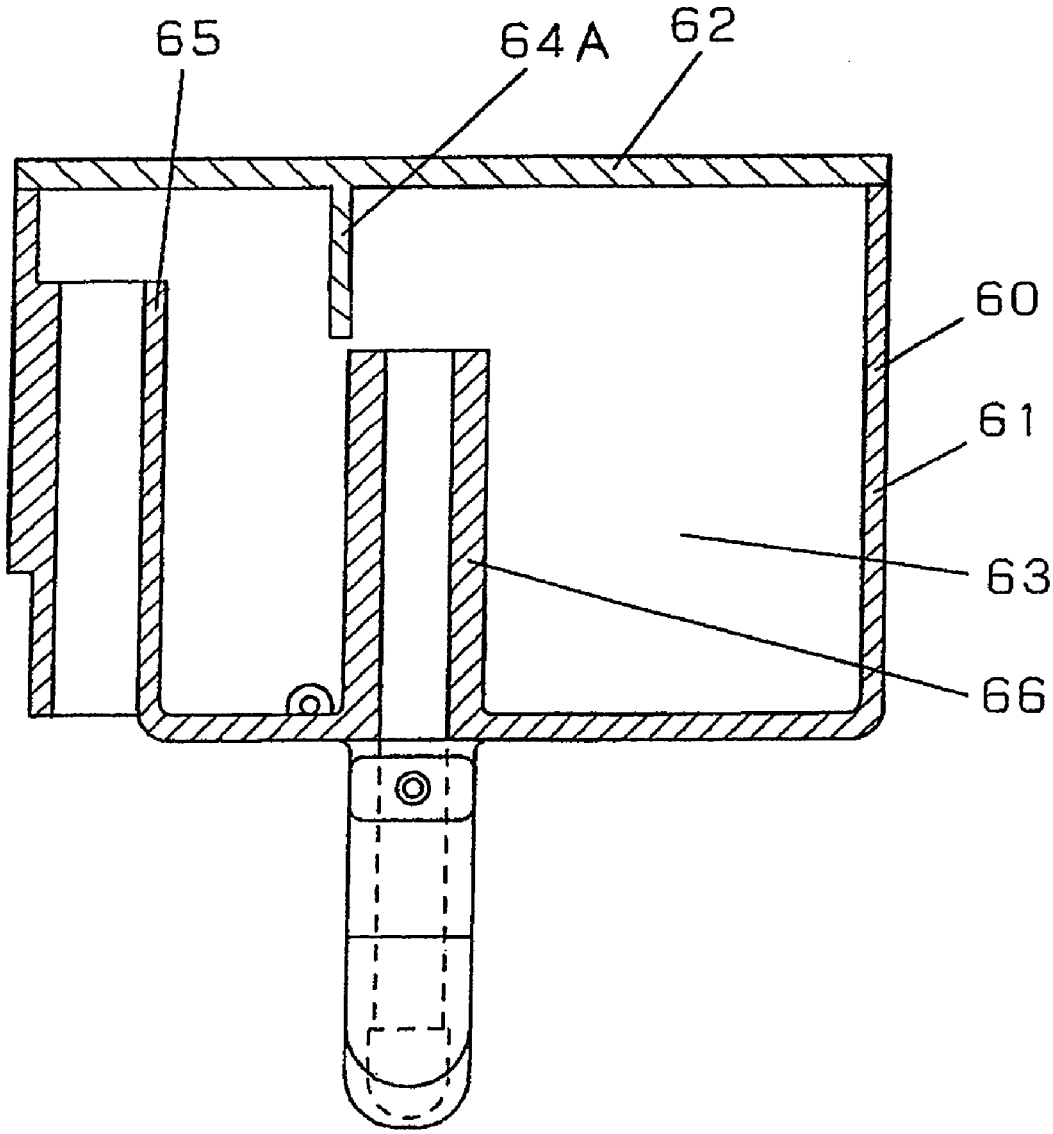
FIG. 17 is a sectional view of a principal part of a suction muffler which corresponds to a modification of the Embodiment 3.

Besides, by forming the shielding wall 64 integrally with the muffler cover 62, the manufacture becomes easy in comparison with a case that separate connecting means is provided for connecting the shielding wall 64 with the muffler main body 61 or the like in order to obtain the same effect on noise, and the cost for providing such connecting means can be eliminated. FIG. 17 is a sectional view of a principal part of a suction muffler which corresponds to a modification of the above-mentioned Embodiment 3. More specifically, the modification shown in FIG. 17 differs from the Embodiment 3 shown in FIG. 6 in that the lower end portion of the shielding wall 64A is located on an unshown straight line extending between the center of an opening portion on the suction muffler side of the inlet pipe 65 and the center of an opening portion on the suction muffler side of the outlet pipe 66.

Embodiment 4

Figure 7:
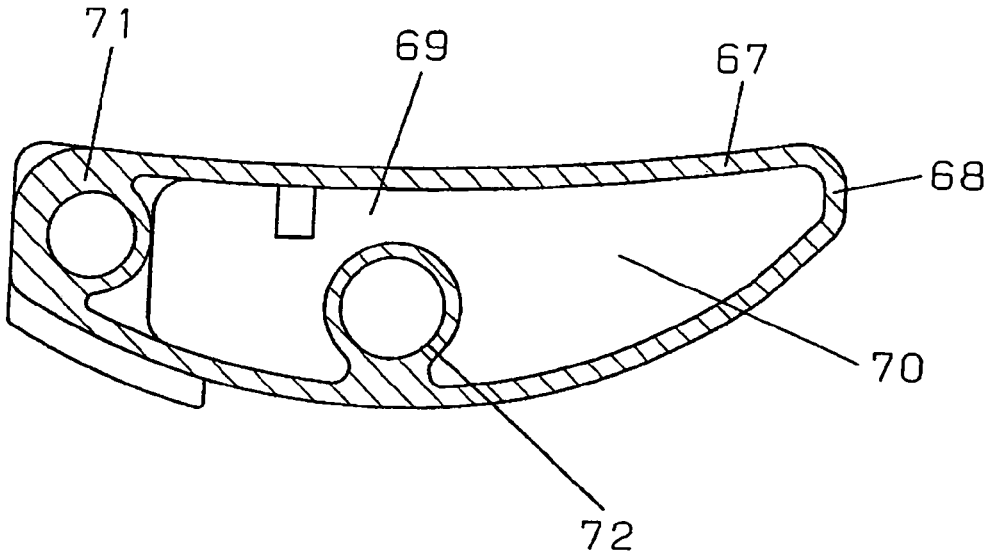
FIG. 7 is a sectional view of a principal part of a suction muffler used in a hermetic compressor according to embodiment 4.

FIG. 7 is a sectional view of a principal part of a suction muffler used in a hermetic compressor according to embodiment 4 of the present invention. Note that the hermetic compressor using the suction muffler illustrated in FIG. 7 differs from the hermetic compressor illustrated in FIG. 1 only in the suction muffler, so it is not illustrated.

In FIG. 7, reference numeral 67 denotes a suction muffler, which is made up from a muffler main body 68 and a muffler cover 69. The muffler main body 68 and the muffler cover 69 are joined with each other through a process of welding or the like to form a muffler space 70.

Reference numeral 71 denotes an inlet pipe, whose one end is open in the hermetic vessel 35 and other end is open in the suction muffler 67. The inlet pipe 71 is formed integrally with the muffler main body 68. Reference numeral 72 denotes an outlet pipe, whose one end is open substantially at the center of the muffler space 70 and other end is open on the compressing element 36 side. The outlet pipe 72 is formed integrally with the muffler main body 68.

The operation of the hermetic compressor constructed as above will be described below. A pressure pulsation having occurred in the compression chamber 39 propagates in the reverse direction to the flow of coolant gas, and then it is once released into the muffler space 70 through the outlet pipe 72. At this time, since the rigidity of the wall surface of the muffler main body 68 against the vibration due to the pressure pulsation has been improved by being formed integrally with the inlet pipe 71 and the outlet pipe 72, the vibration of the wall surface of the muffler main body 68 is sufficiently suppressed. Thus, noise attendant upon the wall surface vibration can be reduced. In particular, the vibration of the wall surface on the hermetic vessel 35 side of the muffler main body 68 is apt to appear as noise in comparison with the wall surface of the electric motor element 37 side because the former is nearer than the latter to the hermetic vessel 35 as a radiating surface of noise of the hermetic compressor. Thus, the improvement of the rigidity of the wall surface on the hermetic vessel 35 side of the muffler main body 68 is effective in view of noise reduction.

Besides, by opening one end of the outlet pipe 72 substantially at the center of the muffler space 70, a low-order resonance vibration that the muffler space 70 has solely, that is, the vibration having its antinode substantially at the center of the muffler space 70 can be suppressed. This attenuates the frequency component of the pressure pulsation corresponding to that vibration and so noise can be reduced more effectively.

Embodiment 5

Figure 8A:
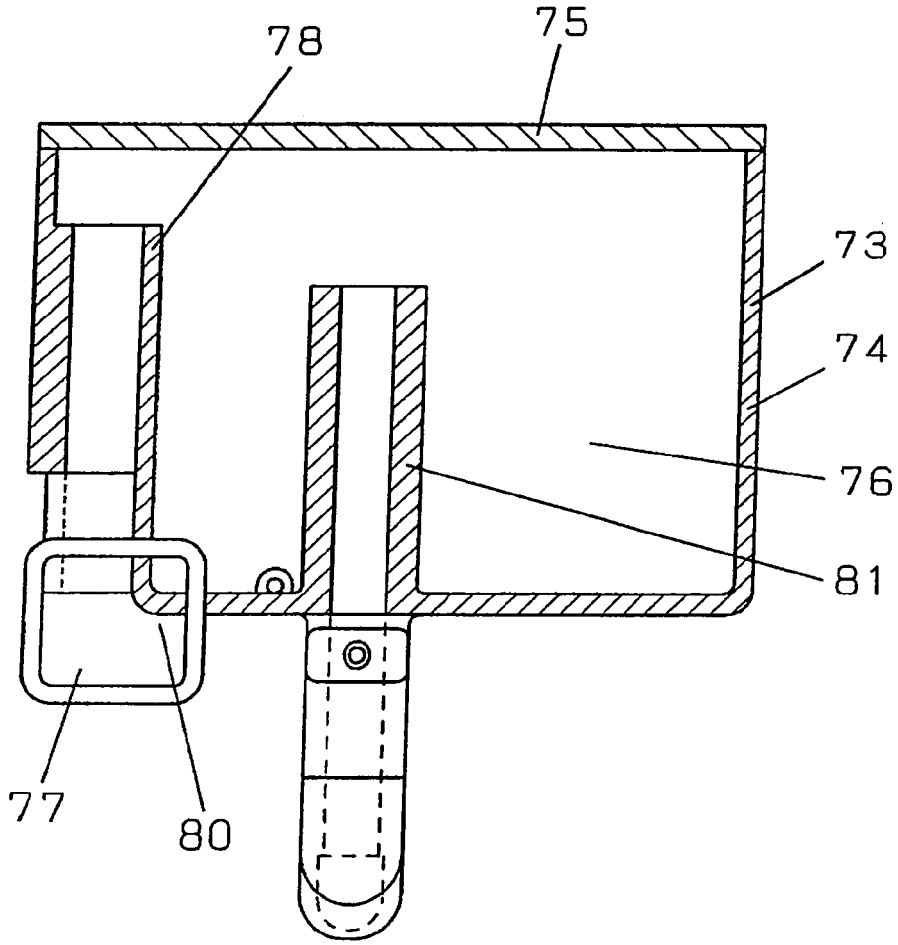
FIG. 8A is a sectional view of a principal part of a suction muffler used in a hermetic compressor according to embodiment 5.
Figure 8B:
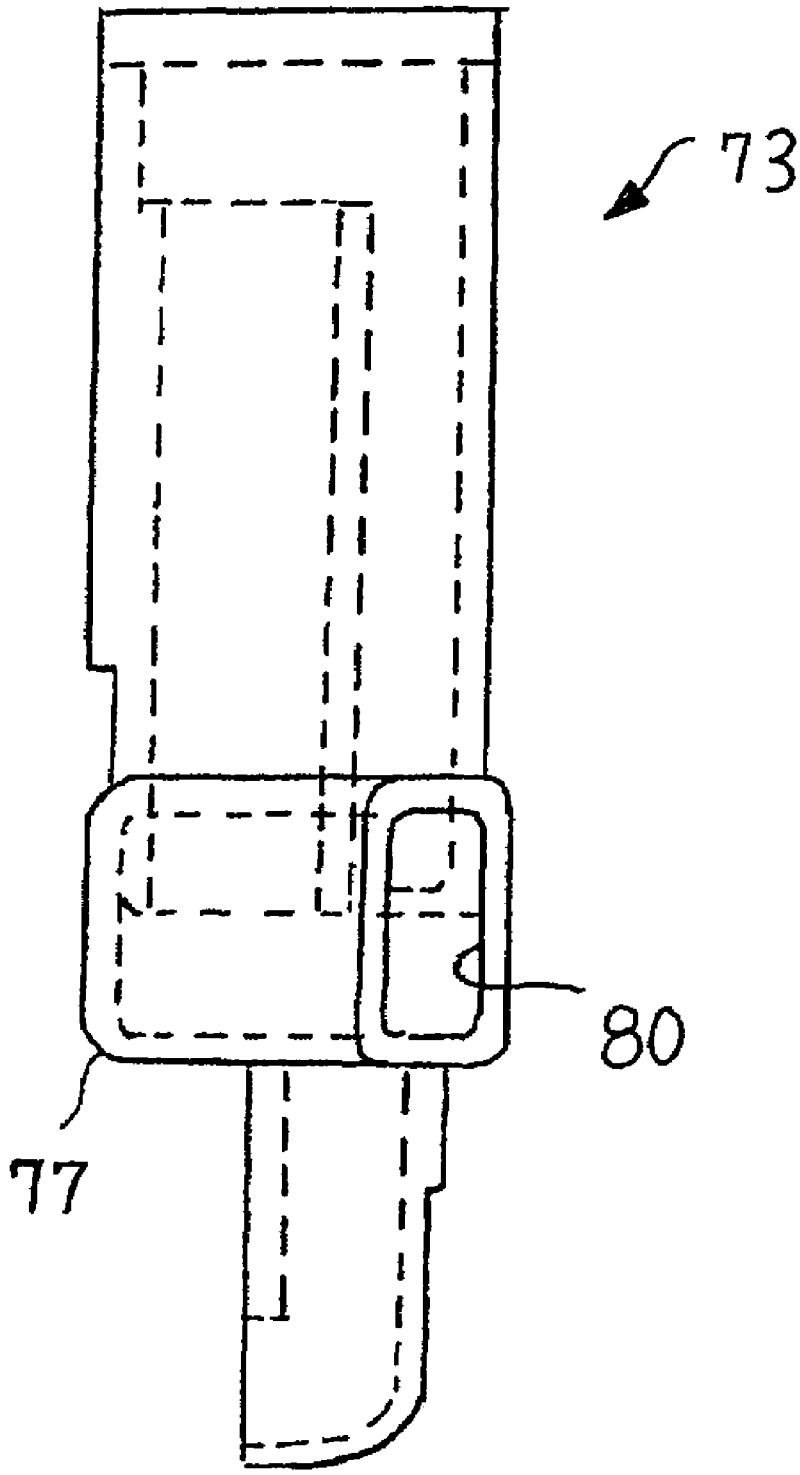
FIG. 8B is a side view of the suction muffler shown in FIG. 8A.
Figure 9:
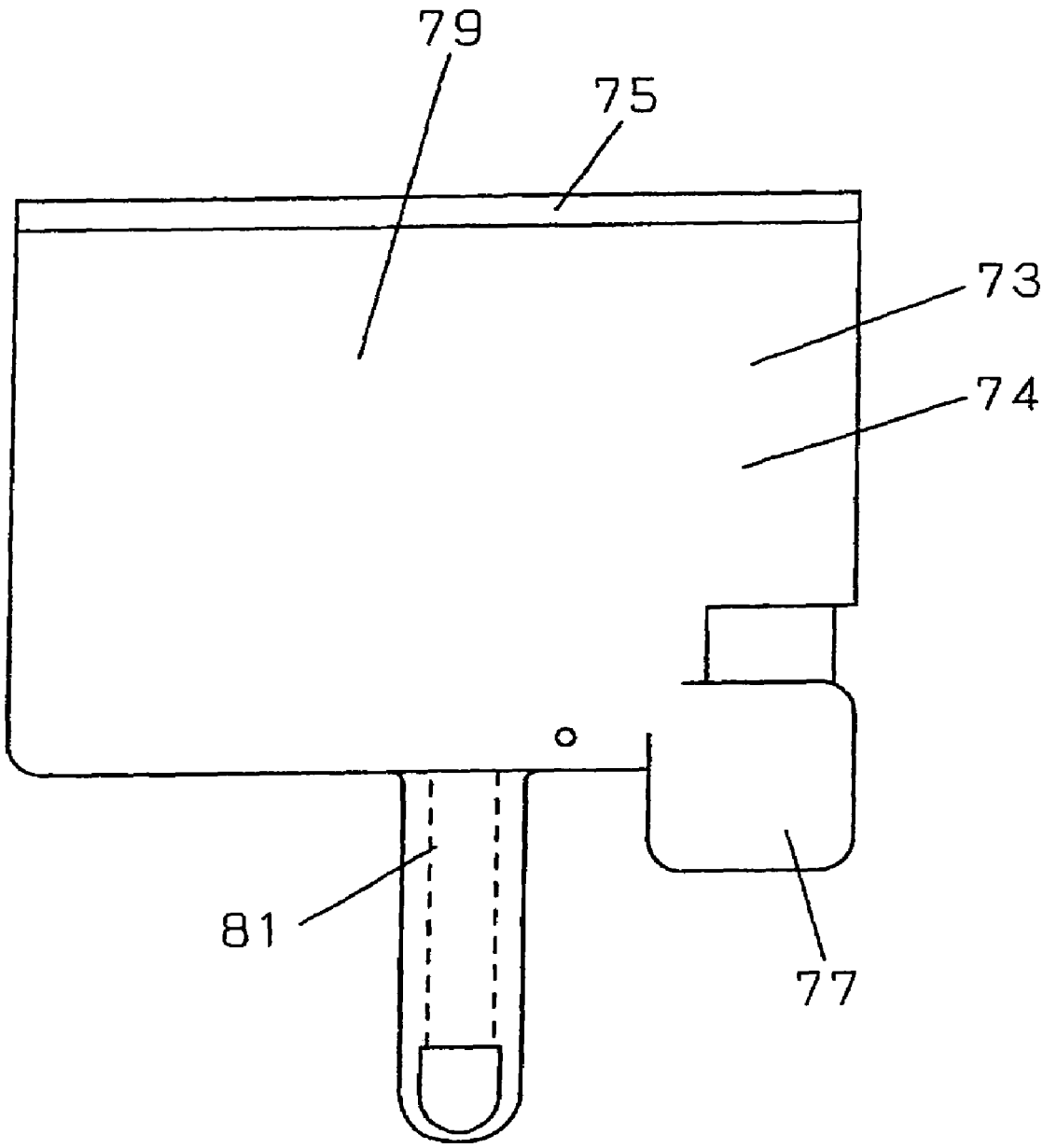
FIG. 9 is a rear view of the suction muffler used in the hermetic compressor according to embodiment 5.

FIG. 8A is a sectional view of a principal part of a suction muffler used in a hermetic compressor according to embodiment 5 of the present invention, and FIG. 8B is a side view of the same. FIG. 9 is a rear view of the suction muffler used in the hermetic compressor according to embodiment 5 of the present invention. Note that the hermetic compressor using the suction muffler illustrated in FIGS. 8 and 9 differs from the hermetic compressor illustrated in FIG. 1 only in the suction muffler, so it is not illustrated.

In FIGS. 8A, 8B and 9, reference numeral 73 denotes a suction muffler, which is made up from a muffler main body 74 and a muffler cover 75. The muffler main body 74 and the muffler cover 75 are joined with each other through a process of welding or the like to form a muffler space 76.

Reference numeral 77 denotes an introducing portion, which is formed integrally with the muffler main body 74. The introducing portion 77 has its one end open in the hermetic vessel and its other end open in an inlet pipe 78. The wall surface where the introducing portion 77 is formed and the wall surface where the muffler main body 74 is formed coincide with each other only at a rear surface 79 and differ from each other in the other wall surfaces. As shown in FIG. 8B, an opening portion 80 on the hermetic vessel 35 side of the introducing portion 77 has a substantially rectangular opening shape, and the introducing portion 77 has a substantially rectangular-parallelepiped inner space and faces to the suction pipe 45 shown in FIG. 2.

The inlet pipe 78 has its one end open in the introducing portion 77 and its other end open in the suction muffler 73. The inlet pipe 78 is formed integrally with the muffler main body 74. Reference numeral 81 denotes an outlet pipe, whose one end is open in the suction muffler 73 and other end is open to the compressing element 36. The outlet pipe 81 is formed integrally with the muffler main body 74.

The operation of the hermetic compressor constructed as above will be described below. Coolant gas having returned from the suction pipe 45 flows through the introducing portion 77 and the inlet pipe 78 into the muffler space 76, and then it is sent to the compression chamber 39 through the outlet pipe 81. At this time, an important point is to send the coolant gas to the compression chamber 39 with keeping the coolant gas at a low temperature. A higher efficiency can be obtained thereby. The introducing portion 77 having the substantially rectangular opening shape and the substantially rectangular-parallelepiped inner space can hold a large amount of coolant gas in its inner space. Besides, the introducing portion 77 can temporarily isolate the coolant gas from the atmosphere in the hermetic vessel 35 at a high temperature. Therefore, the coolant gas can be sent to the compression chamber 39 with being kept at a lower temperature.

On the other hand, a pressure pulsation having occurred in the compression chamber 39 propagates in the reverse direction to the flow of the coolant gas, and then it is once released into the muffler space 76 through the outlet pipe 81. At this time, since the attenuation quantity of the pressure pulsation is determined in accordance with the volume of the muffler space 76, the muffler space 76 is desirably large. By making the inner space of the introducing portion 77 into a substantially rectangular parallelepiped and making the wall surfaces of the suction muffler 73 and the introducing portion 77 coincide with each other only at the rear surface 79, the volume of the muffler space 76 can be increased with keeping the volume of the inner space of the introducing portion 77 large. This realizes a more effective reduction of noise.

Besides, since the introducing portion 77 has the rear surface 79 in common with the muffler main body 74, the cost for molds can be reduced in comparison with a case of providing a separate introducing portion, and in addition, since the material can be less, the cost for manufacture can be reduced.

Embodiment 6

Figure 10:
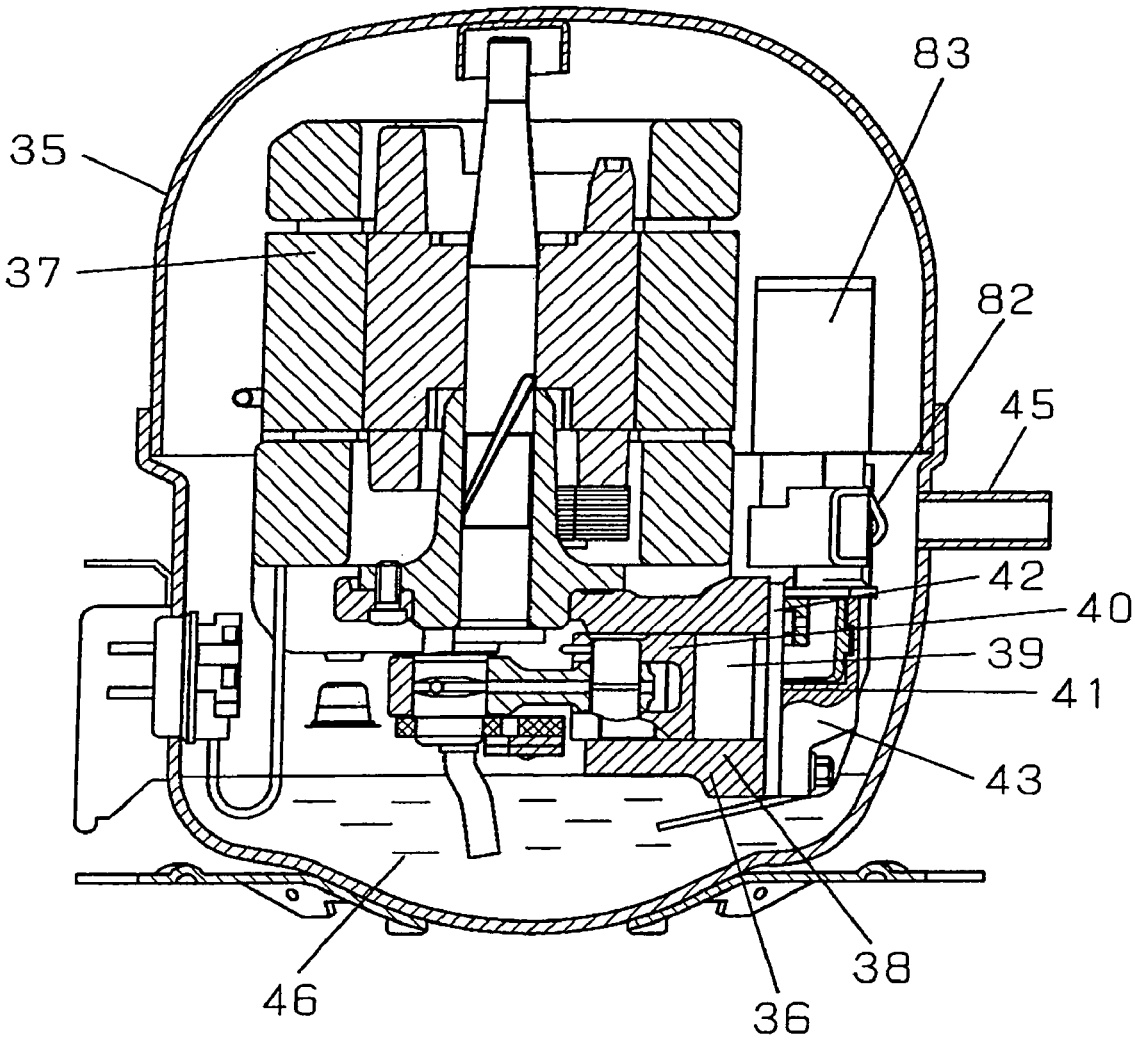
FIG. 10 is a sectional view of a principal part of a hermetic compressor according to embodiment 6.
Figure 11:
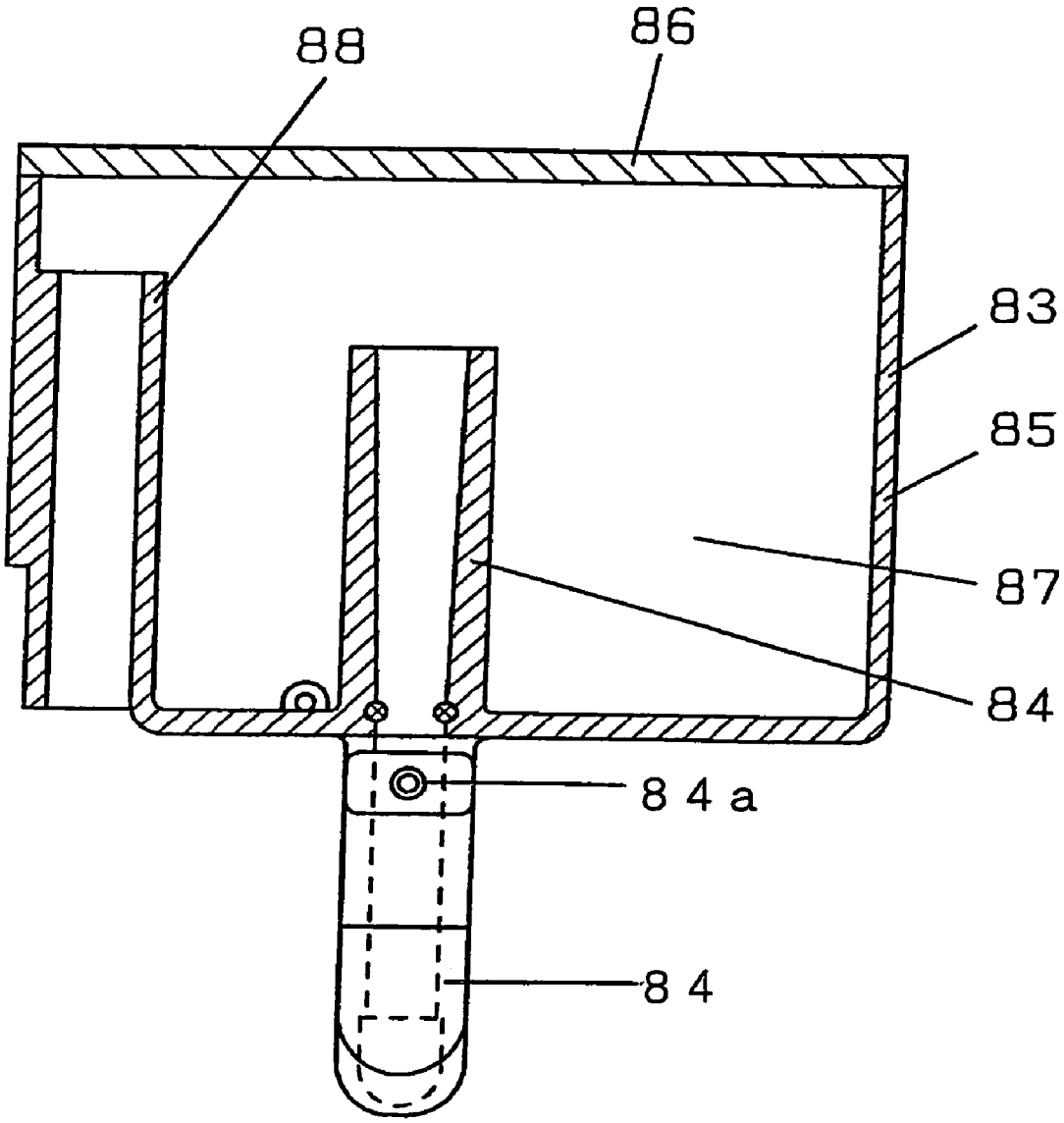
FIG. 11 is a sectional view of a principal part of a suction muffler used in the hermetic compressor according to embodiment 6.

FIG. 10 is a sectional view of a principal part of a hermetic compressor according to embodiment 6 of the present invention. FIG. 11 is a sectional view of a principal part of a suction muffler used in the hermetic compressor according to embodiment 6 of the present invention.

In FIGS. 10 and 11, reference numeral 82 denotes a capillary, whose one end is open in the freezer oil 46 and other end is open in an outlet pipe 84 of a suction muffler 83. The suction muffler 83 is made up from a muffler main body 85 and a muffler cover 86, which are joined with each other through a process of welding or the like to form a muffler space 87.

The muffler main body 85 is provided with an inlet pipe 88 whose one end is open in the hermetic vessel 35 and other end is open in the suction muffler space 87, and the outlet pipe 84 whose one end is open in the suction muffler space 87 and other end is open on the compressing element 36 side. In the outlet pipe 84, the inner diameter on the compressing element 36 side of the outlet pipe 84 is smaller than the inner diameter on the suction muffler space 87 side of the outlet pipe 84 with a boundary at the position substantially equal to the position 84*a* of the opening on the outlet pipe 84 side of the capillary 82 or at a position nearer to the opening portion on the suction muffler 83 side of the outlet pipe 84. The inlet pipe 88 is formed integrally with the muffler main body 85.

The operation of the hermetic compressor constructed as above will be described below. Coolant gas flows into the muffler space 87 through the inlet pipe 88 and then it is sent to the compression chamber 39 through the outlet pipe 84. At this time, since the flow velocity of the coolant gas in the outlet pipe 84 increases from the suction muffler space 87 side toward the compressing element 36 side of the outlet pipe 84 in inverse proportion to the inner diameter of the outlet pipe 84, a sufficiently high flow velocity can be obtained at the opening portion on the outlet pipe 84 side of the capillary 82. By this, since the pressure near the opening portion on the outlet pipe 84 side of the capillary 82 becomes low relatively to the pressure in the hermetic vessel 35, there arises a pressure difference. Thus, the freezer oil 46 staying in the lower portion of the hermetic vessel 35 can be sent out to the compression chamber 39 through the capillary 82 and then the outlet pipe 84.

In general, as a method for obtaining a high flow velocity of the coolant gas in the outlet pipe 84 in order to obtain good lubrication, it is well-known to decrease more the inner diameter of the outlet pipe 84. In this method, however, the pressure loss in the outlet pipe 84 is large and so the efficiency of the hermetic compressor is reduced. Therefore, making the inner diameter on the compressing element 36 side of the outlet pipe 84 smaller than the inner diameter on the suction muffler 83 side of the outlet pipe 84 with the boundary at a position nearer to the opening portion on the suction muffler 83 side of the outlet pipe 84 is an effective measure by which a quantity of freezer oil 46 sufficient for obtaining good lubrication can by supplied to the compression chamber 39 through the capillary 82 with keeping the efficiency of the hermetic compressor, because the flow of the coolant gas in the outlet pipe 84 can gradually be accelerated and the flow of the coolant gas is never hindered.

Embodiment 7

Figure 12:
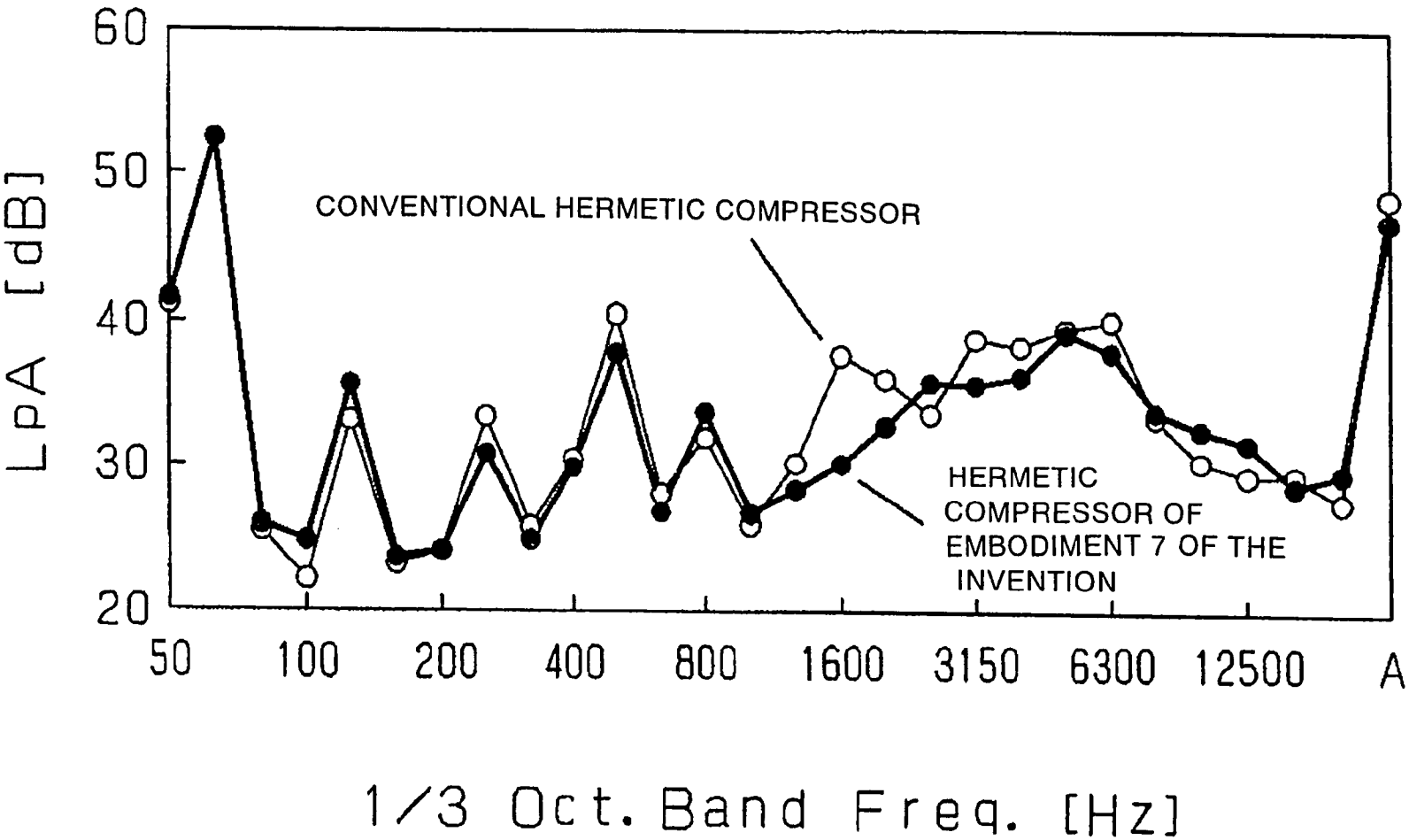
FIG. 12 is a graph showing noise of a hermetic compressor wherein a suction muffler including embodiments 1 to 6 of the present invention is incorporated in a freezing refrigerating system using R134a coolant as a coolant not containing chlorine.
Figure 13:
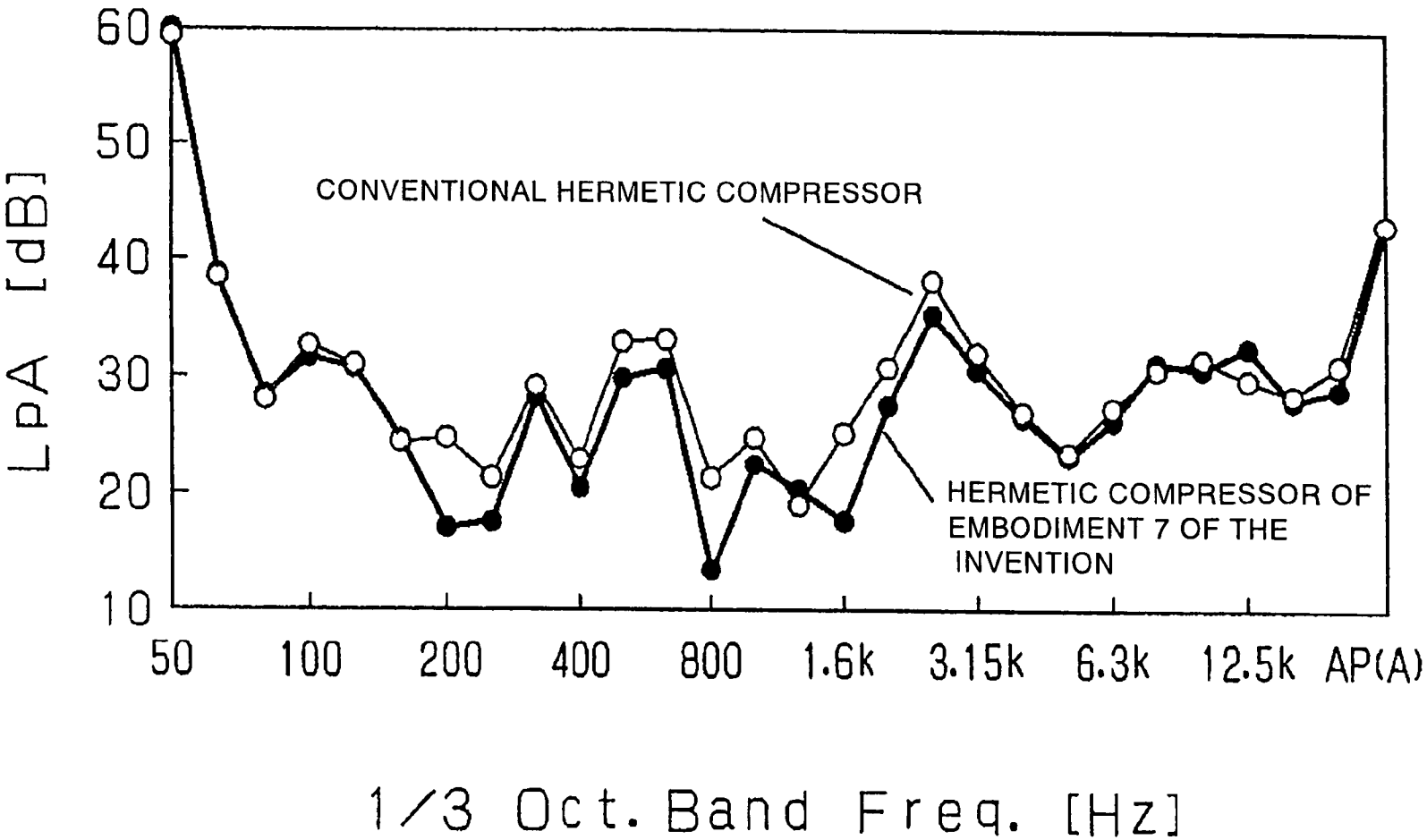
FIG. 13 is a graph showing noise of a hermetic compressor wherein a suction muffler including embodiments 1 to 6 of the present invention is incorporated in a freezing refrigerating system using R600a coolant as a hydrocarbon-base coolant.
Figure 14:
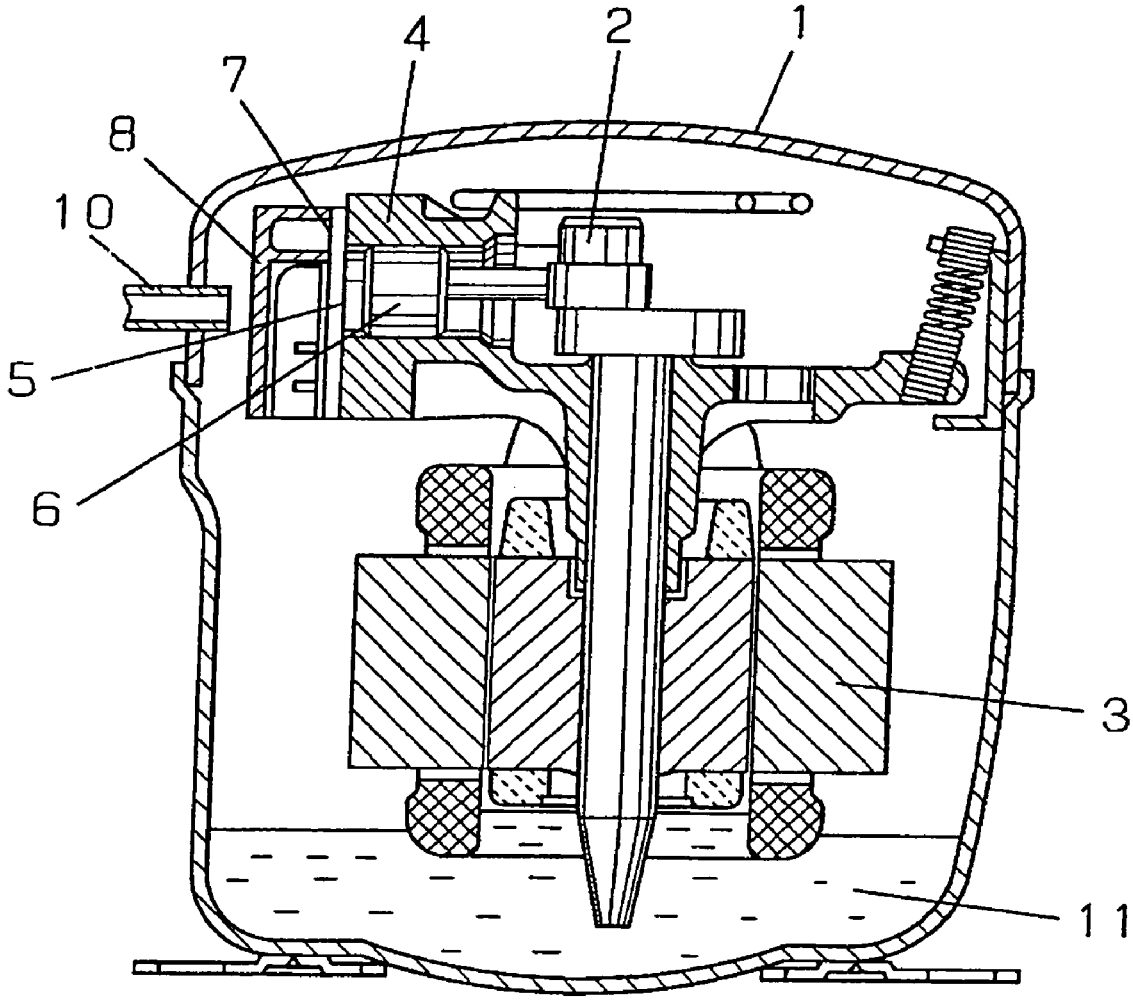
FIG. 14 PRIOR ART
FIG. 14 is a sectional view of a conventional hermetic compressor.
Figure 15:
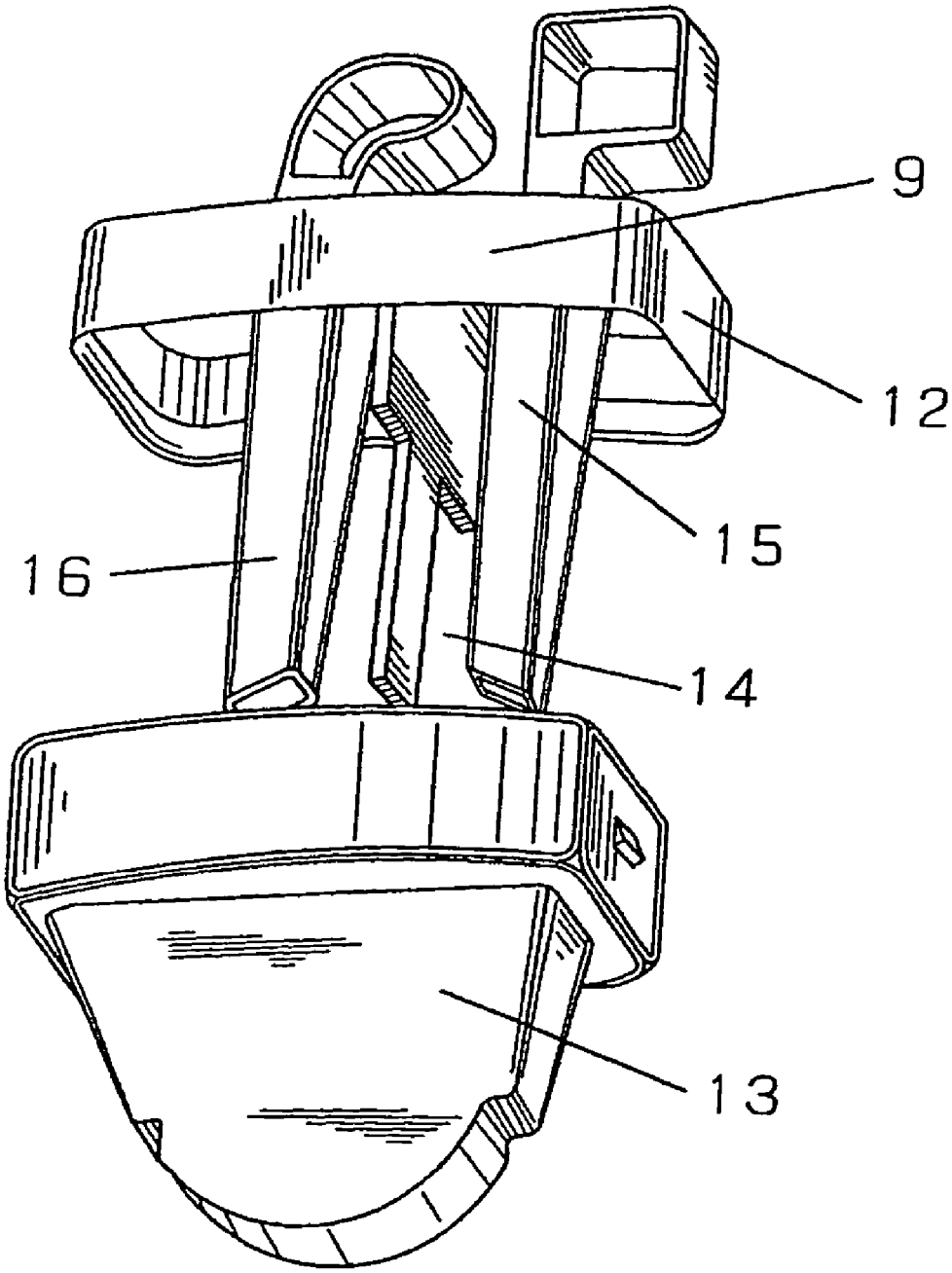
FIG. 15 PRIOR ART
FIG. 15 is an exploded perspective view of a suction muffler attached to the conventional hermetic compressor.
Figure 16:
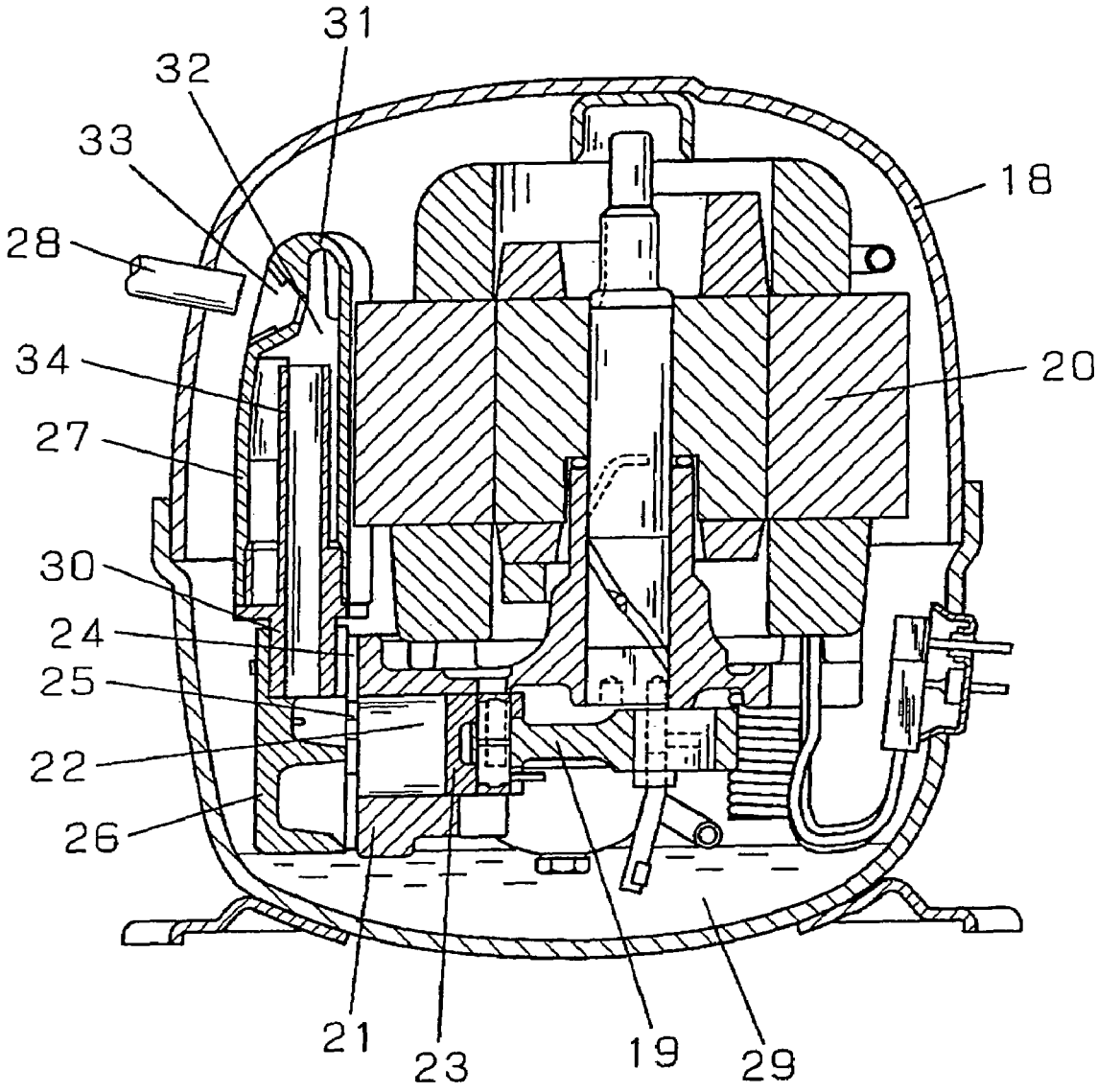
FIG. 16 PRIOR ART
FIG. 16 is a sectional view of another conventional hermetic compressor.

Embodiment 7 of the present invention relates to a freezing refrigerating system and air-conditioning system (not illustrated), such as a refrigerator or a showcase, in which the hermetic compressors according to embodiments 1 to 6 of the present invention is incorporated and which use as their coolants coolants not containing chlorine or hydrocarbon-base coolants. In relation to the freezing air-conditioning system such as a refrigerator, a showcase or the like, results in which noise upon operation was confirmed are shown in FIGS. 12 and 13. FIG. 12 shows noise of a hermetic compressor wherein a suction muffler including embodiments 1 to 6 of the present invention is incorporated in a freezing refrigerating system using R134a coolant as a coolant not containing chlorine, and FIG. 13 shows noise of a hermetic compressor wherein a suction muffler including embodiments 1 to 6 of the present invention is incorporated in a freezing refrigerating system using R600a coolant as a hydrocarbon-base coolant. In either of FIGS. 12 and 13, the axis of abscissas represents one-third octave frequency and its right end indicates the whole sound. The axis of ordinates represents noise level. In the figures, plots with white blank indicate noise of a conventional hermetic compressor and noise according to embodiment 7 of the present invention is indicated by black circles. From these results, in either coolant, a high noise reduction effect relatively to the conventional hermetic compressor was obtained.

More specifically, it was confirmed that noise of 500 Hz in case of using R134a coolant as a coolant not containing chlorine in FIG. 12, and noise of 500 to 630 Hz in case of using R600a coolant as a hydrocarbon-base coolant in FIG. 13, were each reduced by 2 to 3 [dB] due to the provision of the resonance space. Besides, as for noise of 1.6 kHz to 4 kHz, although there were differences in effect width among frequency bands, it was confirmed that noise could be reduced by providing the shielding wall and improving the wall surface rigidity.

INDUSTRIAL APPLICABILITY

As described above, according to the present invention, the muffler cover is made into a simple shape only with a single wall surface. By this, the deformation can be decreased, so a sufficiently close contact can be obtained in the connection between the muffler main body and the muffler cover, and so a pressure pulsation hardly leaks through the connection between the muffler main body and the muffler cover. Therefore, the silencing effect that the suction muffler has can fully be obtained and noise can attenuate more. Besides, since the cost for molds can be reduced and the material weight can be decreased by making the muffler cover into a simple shape, the cost for manufacturing the muffler cover can be reduced. This can realize an inexpensive hermetic compressor.

Besides, according to the present invention, the wall surface for defining the resonance space is formed integrally with the muffler cover. By this, the pressure pulsation component of the frequency corresponding to the resonance space can concentrically be reduced, so noise can attenuate more. Besides, since the resonance space can easily be added without any change in the muffler main body, the cost for manufacture can be reduced. This can realize an inexpensive hermetic compressor.

According to the present invention, at least one or more wall surfaces of the surfaces that define the resonance space are along the inner wall surface of the suction muffler. By this, a large volume of resonance space can be obtained and the reduction effect of the frequency corresponding to the resonance space can be increased, so noise can attenuate more.

According to the present invention, the shielding wall is provided between the opening portion on the suction muffler side of the inlet pipe and the opening portion on the suction muffler side of the outlet pipe. By this, the propagation path of a pressure pulsation having occurred in the compression chamber can be elongated through the reflection on the shielding wall. Therefore, a large attenuation can be obtained and an effective noise reduction can be intended.

According to the present invention, the shielding wall is formed integrally with one of the wall surfaces of the suction muffler. By this, it can easily be manufactured without providing separate connecting means for the shielding wall and the suction muffler, so the cost for manufacture can be reduced. In addition, since the propagation path of a pressure pulsation having occurred in the compression chamber can be elongated through the reflection on the shielding wall, a large attenuation can be obtained and an effective noise reduction can be intended.

According to the present invention, the shielding wall is formed integrally with the suction muffler. By this, the shielding wall can easily be added without any change in the muffler main body, so the cost for manufacture can be reduced. In addition, since the propagation path of a pressure pulsation having occurred in the compression chamber can be elongated through the reflection on the shielding wall, a large attenuation can be obtained and an effective noise reduction can be intended.

According to the present invention, the lower end portion of the shielding wall is located on a straight line extending between the center of the opening portion on the suction muffler side of the inlet pipe and the center of the opening portion on the suction muffler side of the outlet pipe, or nearer to a position on the upper end portion side of the shielding wall. By this, it serves as a fluid resistance only against a pressure pulsation having occurred in the compression chamber. Therefore, since the propagation path of the pressure pulsation having occurred in the compression chamber can be elongated through the reflection on the shielding wall without hindering the efficiency, a large attenuation can be obtained and an effective noise reduction can be intended with keeping the efficiency.

According to the present invention, a wall surface of the suction muffler is formed integrally with the inlet pipe and the outlet pipe. Since the rigidity of the wall surface of the suction muffler can be improved thereby, the wall surface vibration even due to the vibration by a pressure pulsation can be suppressed, so an effective noise reduction can be intended.

According to the present invention, the opening portion on the suction muffler side of the outlet pipe is located substantially at the center of the suction muffler space. Since a low-order resonance vibration that the muffler space has solely can be suppressed thereby, a more effective noise reduction can be intended.

According to the present invention, the outlet pipe is formed integrally with the wall surface on the hermetic vessel side of the suction muffler. Since the rigidity of the wall surface on the hermetic vessel side of the suction muffler can be improved thereby, the wall surface vibration on the hermetic vessel side that is apt to appear as noise can be suppressed, so a more effective noise reduction can be intended.

According to the present invention, the introducing portion is formed by a wall surface different from a wall surface of the suction muffler and the opening portion on the suction muffler side of the introducing portion faces the suction pipe by a wall surface of the introducing portion. By this, a large volume of introducing portion can be obtained without reducing the muffler space. Therefore, since the volume of the muffler space is never reduced, noise is reduced more effectively. Besides, since coolant gas can temporarily be isolated from the atmosphere in the hermetic vessel at a high temperature and held in this state, the coolant gas can be introduced into the suction muffler while being kept at a low temperature, so a high efficiency can be obtained. In addition, since the cost for molds can be reduced in comparison with a case of providing a separate introducing portion and the material can be decreased, a cost reduction can be intended.

According to the present invention, the introducing portion has the substantially rectangular opening portion on the hermetic vessel side and the substantially rectangular-parallelepiped inner space. By this, a larger volume of introducing portion can be obtained without reducing the muffler space. Therefore, a larger amount of coolant gas can be introduced into the suction muffler at a low temperature, so a higher efficiency can be obtained.

According to the present invention, the outlet pipe of the suction muffler is made into a pipe continuous body having at least two different inner diameters. Since the flow velocity of coolant gas in the outlet pipe can be increased thereby, a sufficient supply quantity of freezer oil from the capillary can be ensured, so good lubrication can be obtained.

According to the present invention, the inner diameter of the pipe on the compressing element side of the outlet pipe is smaller than the inner diameter of the pipe on the suction muffler side of said outlet pipe. By this, the flow velocity of coolant gas in the pipe on the compressing element side of the outlet pipe can be higher than the flow velocity of the coolant gas in the pipe on the suction muffler side of the outlet pipe so as not to hinder the flow of the coolant gas from the opening portion on the suction muffler side toward the opening portion on the compressing element side of the outlet pipe. Therefore, a sufficient supply quantity of freezer oil from the capillary can be ensured and better lubrication can be obtained.

According to the present invention, the connecting position between the pipe on the compressing element side of the outlet pipe and the pipe on the suction muffler side of the outlet pipe is substantially equal to the outlet pipe opening position of the capillary, or at a position nearer to the opening portion on the suction muffler side of the outlet pipe. Since the pressure near the outlet pipe opening position of the capillary is thereby low relatively to the pressure in the hermetic vessel, there arises a pressure difference. A quantity of freezer oil sufficient for obtaining good lubrication can be sent out to compression through the capillary, so better lubrication can be obtained.

The present invention is a hermetic compressor used for a coolant not containing chlorine, wherein all effects as described above can be obtained even under the coolant environment not containing chlorine.

The present invention is a hermetic compressor used for a hydrocarbon-base coolant, wherein all effects as described above can be obtained even under the hydrocarbon-base coolant environment.

According to the present invention, the hermetic compressor is applied to a freezing refrigerating system or an air-conditioning system such as a refrigerator or a showcase. Since all effects as described above can be obtained, a freezing refrigerating system or an air-conditioning system becomes possible in which noise caused by the hermetic compressor has been reduced and which is highly reliable and safe even for the environment.

The invention claimed is:

1. A hermetic compressor comprising a hermetic vessel, an electric motor element disposed in said hermetic vessel, a compressing element to be driven and rotated by said electric motor element, a suction pipe disposed in said hermetic vessel, and a suction muffler made up from a muffler main body and a muffler cover, inner wall surfaces of said muffler main body and an inner wall surface of said muffler cover defining a muffler space so that said inner wall surface of said muffler cover defines the top wall surface of said suction muffler, said muffler main body comprising:

an inlet pipe whose one end is open in said hermetic vessel and other end is open in said suction muffler, and an outlet pipe whose one end is open in said suction muffler and other end is open to said compressing element, said muffler cover comprising:

a tubular wall independent of the inner wall surfaces of said main muffler main body extending downwardly from said muffler cover for defining a resonance space in said muffler space, said tubular wall being formed integrally with said muffler cover.

2. The hermetic compressor according to claim 1, wherein a portion of said wall surface defining said resonance space is located along at least one of said inner wall surfaces of said muffler main body.

3. The hermetic compressor according to claim 1, wherein said compressing element is arranged to compress a gas of a coolant not containing chlorine.

4. The hermetic compressor according to claim 1, wherein said compressing element is arranged to compress a gas of a hydrocarbon-base coolant.

5. A hermetic compressor comprising a hermetic vessel, an electric motor element disposed in said hermetic vessel, a compressing element to be driven and rotated by said electric motor element, a suction pipe disposed in said hermetic vessel, and a suction muffler having a one piece muffler body and a muffler cover, said suction muffler having a construction comprising an inlet pipe whose one end is open in said hermetic vessel and other end is open in said suction muffler, an outlet pipe whose one end is open in said suction muffler and other end is open to said compressing element, and a shielding wall between an opening portion on said suction muffler side of said inlet pipe and an opening portion on said suction muffler side of said outlet pipe, said shielding wall being integrally formed with said muffler cover and extending downward from said muffler cover to divide a muffler space between an extension of said opening portion on said suction muffler side of said inlet pipe and an extension of said opening portion on said suction muffler side of said outlet pipe, said shielding wall extending in a direction opposite to a direction of gas flow through said inlet pipe and in a direction of gas flow through said outlet pipe, said inlet pipe and said outlet pipe integrally formed with the one piece muffler body.

6. The hermetic compressor according to claim 5, wherein a lower end portion of said shielding wall is located on a straight line extending between the center of an opening portion on said suction muffler side of said inlet pipe and the center of an opening portion on said suction muffler side of said outlet pipe, or nearer to a position on an upper end portion side of the shielding wall.

7. The hermetic compressor according to claim 5, wherein said compressing element is arranged to compress a gas of a coolant not containing chlorine.

8. The hermetic compressor according to claim 5, wherein said compressing element is arranged to compress a gas of a hydrocarbon-base coolant.

9. A hermetic compressor comprising a hermetic vessel, an electric motor element disposed in said hermetic vessel, a compressing element to be driven and rotated by said electric motor element, a suction pipe disposed in said hermetic vessel, and a suction muffler made up from a muffler main body and a muffler cover, inner wall surfaces of said muffler main body and an inner wall surface of said muffler cover defining a muffler space in such a manner that an upper side wall surface of wall surfaces defining said muffler space corresponds to said inner wall surface of said muffler cover, said muffler main body comprising:

an inlet pipe whose one end is open in said hermetic vessel at a lower portion of said suction muffler and other end is open in said suction muffler, and an outlet pipe whose one end is open in said suction muffler and other end is open to said compressing element, wherein said inlet pipe being formed integrally with one of said wall surfaces which wall surface corresponds to a side wall surface of said muffler main body so that said inlet pipe and said muffler main body are formed as a one-piece member, and said outlet pipe being formed integrally, along its entire length, with one of said wall surfaces on the hermetic vessel side of said suction muffler which wall surface corresponds to a side wall surface of said muffler main body.

10. The hermetic compressor according to claim 9, wherein an opening portion on said suction muffler side of said outlet pipe is located substantially at the center of a space in said suction muffler.

11. The hermetic compressor according to claim 9, wherein said compressing element is arranged to compress a gas of a coolant not containing chlorine.

12. The hermetic compressor according to claim 9, wherein said compressing element is arranged to compress a gas of a hydrocarbon-base coolant.

13. A hermetic compressor comprising a hermetic vessel, an electric motor element, a compressing element to be driven and rotated by said electric motor element, freezer oil staying in a lower portion of said hermetic vessel, a suction pipe disposed in said hermetic vessel, a suction muffler, and a capillary whose one end is open in said freezer oil and other end is open in an outlet pipe of said suction muffler, said suction muffler having an inlet pipe whose one end is open in said hermetic vessel and other end is open in said suction muffler, one end of said outlet pipe being open in said suction muffler and other end being open to said compressing element, said outlet pipe being composed of an integrally formed one-piece continuous body of two pipes which are a compressing element side pipe and a suction muffler side pipe, wherein said compressing element side pipe has an inner diameter substantially uniform along its entire length, and said suction muffler side pipe has an inner diameter which increases, along its entire length, toward an open end within said suction muffler, each of said compressing element side pipe and said suction muffler side pipe being formed of a single pipe with a single gas flow passage.

14. The hermetic compressor according to claim 13, wherein a connecting position between a pipe on said compressing element side of said outlet pipe and a pipe on said suction muffler side of said outlet pipe is substantially equal to said outlet pipe opening position of said capillary, or at a position nearer to an opening portion on said suction muffler side of said outlet pipe.

15. The hermetic compressor according to claim 13, wherein said compressing element is arranged to compress a gas of a coolant not containing chlorine.

16. The hermetic compressor according to claim 13, wherein said compressing element is arranged to compress a gas of a hydrocarbon-base coolant.

17. A freezing air-conditioning system, in which a hermetic compressor is incorporated, said hermetic compressor comprising a hermetic vessel, an electric motor element disposed in said hermetic vessel, a compressing element to be driven and rotated by said electric motor element, a suction pipe disposed in said hermetic vessel, and a suction muffler made up from a muffler main body and a muffler cover, inner wall surfaces of said muffler main body and an inner wall surface of said muffler cover defining a muffler space so that said inner wall surface of said muffler cover defines the top wall surface of said suction muffler, said muffler main body comprising:

an inlet pipe whose one end is open in said hermetic vessel and other end is open in said suction muffler, and an outlet pipe whose one end is open in said suction muffler and other end is open to said compressing element, said muffler cover comprising:

a tubular wall independent of the inner wall surfaces of said main muffler main body extending downwardly from said muffler cover for defining a resonance space in said muffler space, said tubular wall being formed integrally with said muffler cover.

18. A freezing air-conditioning system, in which a hermetic compressor is incorporated, said hermetic compressor comprising a hermetic vessel, an electric motor element disposed in said hermetic vessel, a compressing element to be driven and rotated by said electric motor element, a suction pipe disposed in said hermetic vessel, and a suction muffler having a one piece muffler body, said suction muffler having a construction comprising an inlet pipe whose one end is open in said hermetic vessel and other end is open in said suction muffler, an outlet pipe whose one end is open in said suction muffler and other end is open to said compressing element, and a shielding wall between an opening portion on said suction muffler side of said inlet pipe and an opening portion on said suction muffler side of said outlet pipe, said shielding wall being integrally formed with said muffler cover and extending downward from said muffler cover to divide a muffler space between an extension of said opening portion on said suction muffler side of said inlet pipe and an extension of said opening portion on said suction muffler side of said outlet pipe, said shielding wall extending in a direction opposite to a direction of gas flow through said inlet pipe and in a direction of gas flow through said outlet pipe, said inlet pipe and said outlet pipe integrally formed with the one piece muffler body.

19. A freezing air-conditioning system, in which a hermetic compressor is incorporated, said hermetic compressor comprising a hermetic vessel, an electric motor element disposed in said hermetic vessel, a compressing element to be driven and rotated by said electric motor element, a suction pipe disposed in said hermetic vessel, and a suction muffler made up from a muffler main body and a muffler cover, inner wall surfaces of said muffler main body and an inner wall surface of said muffler cover defining a muffler space in such a manner that an upper side wall surface of wall surfaces defining said muffler space corresponds to said inner wall surface of said muffler cover, said muffler main body comprising:

an inlet pipe whose one end is open in said hermetic vessel at a lower portion of said suction muffler and other end is open in said suction muffler, and an outlet pipe whose one end is open in said suction muffler and other end is open to said compressing element, wherein said inlet pipe being formed integrally with one of said wall surfaces which wall surface corresponds to a side wall surface of said muffler main-body so that said inlet pipe and said muffler main body are formed as a one-piece member, and said outlet pipe being formed integrally, along its entire length, with one of said wall surfaces on the hermetic vessel side of said suction muffler which wall surface corresponds to a side wall surface of said muffler main body.

20. A freezing air-conditioning system such as a refrigerator, a showcase, or the like, in which a hermetic compressor is incorporated, said hermetic compressor comprising a hermetic vessel, an electric motor element, a compressing element to be driven and rotated by said electric motor element, freezer oil staying in a lower portion of said hermetic vessel, a suction pipe disposed in said hermetic vessel, a suction muffler, and a capillary whose one end is open in said freezer oil and other end is open in an outlet pipe of said suction muffler, said suction muffler having an inlet pipe whose one end is open in said hermetic vessel and other end is open in said suction muffler, one end of said outlet pipe being open in said suction muffler and other end being open to said compressing element, said outlet pipe being composed of an integrally formed one-piece continuous body of two pipes which are a compressing element side pipe and a suction muffler side pipe, wherein said compressing element side pipe has an inner diameter substantially uniform along its entire length, and said suction muffler side pipe has an inner diameter which increases, along its entire length, toward an open end within said suction muffler, each of said compressing element side pipe and said suction muffler side pipe being formed of a single pipe with a single gas flow passage.

* * * * *